US009957673B1

(12) United States Patent
Eren

(10) Patent No.: US 9,957,673 B1
(45) Date of Patent: May 1, 2018

(54) POST-TENSION RUNNING TRACK

(71) Applicant: Classic Turf Company LLC, Woodbury, CT (US)

(72) Inventor: John Eren, Bethlehem, CT (US)

(73) Assignee: CLASSIC TURF COMPANY LLC, Woodbury, CT (US)

( * ) Notice: Subject to any disclaimer, the term of this patent is extended or adjusted under 35 U.S.C. 154(b) by 0 days. days.

(21) Appl. No.: 15/340,276

(22) Filed: Nov. 1, 2016

(51) Int. Cl.

| | |
|---|---|
| ***E01C 7/00*** | (2006.01) |
| ***E01C 13/02*** | (2006.01) |
| ***E01C 7/16*** | (2006.01) |
| ***E01C 13/06*** | (2006.01) |
| ***E01C 11/20*** | (2006.01) |

(52) U.S. Cl.
CPC ..... *E01C 13/02* (2013.01); *E01C 7/16* (2013.01); *E01C 11/20* (2013.01); *E01C 13/065* (2013.01)

(58) Field of Classification Search
CPC . E01C 7/16; E01C 11/20; E01C 13/02; E01C 13/065
USPC ..... 404/17, 31, 72
See application file for complete search history.

(56) References Cited

U.S. PATENT DOCUMENTS

| | | | | |
|---|---|---|---|---|
| 4,191,490 | A * | 3/1980 | Barnett | E01B 3/34 404/44 |
| 4,605,337 | A * | 8/1986 | Springston | E01C 9/008 404/35 |
| 6,435,765 | B1 | 8/2002 | Crane et al. | |
| 8,636,441 | B2 * | 1/2014 | French | B28L 7/186 404/45 |
| 9,114,307 | B1 * | 8/2015 | Rittenberry | A63C 19/00 |

* cited by examiner

*Primary Examiner* — Raymond W Addie
(74) *Attorney, Agent, or Firm* — Leason Ellis LLP

(57) ABSTRACT

A running track includes a reinforced concrete slab base that is poured over and around post-tensioning cables suspended therein. The post-tensioning cables include transverse cables that extend transversely across the base, and lengthwise cable structures extending lengthwise through the base. Each lengthwise cable structure includes a series of individual segments that are joined end-to-end to form respective continuous loops and are individually tensioned. The lengthwise cable structures thus exert compressive forces on the base that are continuous and uninterrupted about the circumferential length of the track. The lengthwise cable segments are joined/tensioned from within voids initially formed within the concrete base and, after tensioning, these voids are filled with concrete to provide a concrete base having a uniform top surface that can also be covered in a running surface.

21 Claims, 13 Drawing Sheets

POST-TENSION RUNNING TRACK

TECHNICAL FIELD OF THE INVENTION

The invention relates to running track constructions and more particularly to a running track having a post-tensioned concrete base.

BACKGROUND OF THE INVENTION

Track and field sporting events are commonly held on running tracks. As would be understood by those in the art, running tracks come in various sizes and configurations that can vary depending on the standards implemented by different athletic organizations. Typically the main portion of the running track has an oval shape defined by two opposing semi-circular end sections or "turns" that are connected by two parallel and opposing rectangular side areas.

In some instances the base and the surface of the track (i.e., the useable surface that competitors run on) are defined by a single structure. However, in some configurations, the track is a composite structure defined by multiple substrate layers and multiple different materials. Typically, in such composite configurations, a concrete or bituminous concrete (i.e., asphalt) base/foundation is poured or placed on top of a prepared sub-base and the base acts as the primary structural layer that supports the top-most running surface. The running surface is often a resilient composite such as a polymer based material, asphalt, or a mixture of materials.

Irrespective of the track construction, it is preferable that the base provide a structurally sound and uniform base. It is also preferable that the track not develop cracks and maintain a consistent and generally level surface (e.g., without undulations or variations) through changing environmental conditions and usual wear and tear, as irregularities can cause injuries.

Cracking or irregularities in the level of the base often occurs in concrete slab surfaces and asphalt bases due to the expansion or contraction of the ground that supports the slab and the areas surrounding the base. More specifically, the moisture content of the soil that supports a floating slab can vary across the area of the slab and in the immediate vicinity and, accordingly, the ground expands or contracts differentially across the underside of the slab causing the slab to bend accordingly. For example, moisture trapped underneath a section of the base can freeze in the winter-time thereby lifting that section of the base relative to the surrounding portions of the base. These stresses can result in deformation of the base and cracking if the stresses exceed the tensile strength of the base. Swelling, or shrinking of the earth under or around the base can result from seasonal, short-term environmental conditions as well as more long-term environmental conditions also relating to climate and environment. By way of further example, moisture trapped within the base can also cause stresses and cracking of the base, for instance due to freezing and expansion of the moisture. In addition to experiencing significant flexing due to changes in the earthen base underneath the slab and the weight of any loads on the slab as described above running tracks can also expand and contract with changes in temperature. These conditions can result in cracking, which allows water and other environmental elements to further deteriorate the base and any metal structural reinforcements within the slab.

The foregoing problems are common to various floating slab constructions. One factor bearing upon the use of concrete is the fact that it is strong in compression, but relatively weak in tension. One method that is used to overcome the disadvantages of concrete's low tensile strength is through reinforcement. This can be accomplished by use of high strength steel wires, cables, or rods embedded within the concrete. One method for reinforcing concrete is post-tensioning in which un-bonded cables are suspended within the slab. After the slab of concrete has been poured and has set, the cables are pulled to a preselected tension using tensioning equipment, thereby putting the slab under a compressive load acting in the direction of the cables. Accordingly, when the slab receives a load, the compression is relieved on that portion, which would otherwise be in tension if not pre-compressed. Thus, for example, a slab is pre-stressed so that when the concrete is under load, the side of the slab that would otherwise be in tension if not pre-stressed, has less net tensile forces acting upon it. A permanent compressive load on the concrete helps the slab resist cracking as the supporting ground swells and shrinks with changing environmental conditions.

As noted above, a typical layout of a running track primarily consists of a flat, continuous oval shaped slab that surrounds an interior area. The generally narrow width of the track surface and the overall end to end length of the track presents special concerns in the installation and construction of a post-tensioned floating slab base that has sufficient structural integrity. One such concern is to minimize the thickness of the slab, which results in a lower total volume of concrete required for the slab and associated cost, while still providing a running track base that can withstand the stresses brought by environmental conditions and use and have a long useful life.

There remains a need, therefore, for an athletic track having a post-tensioned concrete slab foundation that has improved resistance to cracking than existing post-tensioned athletic track designs. It is with respect to these and other considerations that the disclosure made herein is presented.

SUMMARY OF THE INVENTION

According to a first aspect, a method of constructing a post-tensioned running track is provided. The method includes the steps of forming a footprint of a base that has an inner edge, an outer edge and a width there-between and extends continuously around an interior area. The method also includes the step of arranging a plurality of transverse post-tensioning cables within the footprint, wherein the transverse cables extend in a transverse direction across the width at respective locations. The method also includes the step of arranging multiple sets of lengthwise post-tensioning cable segments within the footprint. Each set comprises a plurality of lengthwise cable segments arranged in series and extending in a lengthwise direction such that each set of lengthwise cable segments extends about the footprint at a respective position between the inner edge and the outer edge. The method also includes the step of defining sets of box-out areas within the footprint using box-out forms. The sets of box-out areas are spaced apart in the lengthwise direction and each set of box-out areas includes a plurality of individual box out areas that are spaced apart in the transverse direction. In addition, the box-out sets and lengthwise cable segments are arranged such that the lengthwise cable segments begin and end in respective box-out areas. Constructing the track also includes the step of placing concrete throughout the footprint to form a concrete base structure and around sides of the box-out forms thereby leaving any ends of lengthwise cable segments exposed within respective box-out areas. In addition, the method includes, for each set of lengthwise cable segments, joining the lengthwise cable segments in series in respective box-out areas thereby defining a respective lengthwise cable structure that extends continuously about an entire circumferential length of the base and then performing a partial tensioning of the transverse and lengthwise cable segments. In addition, the method includes performing a final tensioning of the transverse and lengthwise cable segments. The method is completed by filling the box-out areas with concrete thereby surrounding respective joined lengthwise cable segments disposed within the box-out areas with concrete. The method thereby provides a concrete base structure having a top-surface layer of concrete that extends throughout the footprint of the track and the wherein compression on the concrete base structure in the lengthwise direction is continuous and uninterrupted about the entire circumferential length of the base.

According to another aspect, a post-tensioned running track is provided. In particular, the track comprises a concrete base extending circumferentially around an interior area and that includes an inner edge and an outer edge and a width there-between. The track also includes a plurality of transverse post-tensioning cables provided within the concrete base and extending in a transverse direction across the width of the concrete base at respective locations. In addition, multiple sets of box-out areas provided in the concrete base, wherein the sets of box-out areas are spaced apart from one another along the length of the concrete base. Moreover, each set of box-out areas includes a plurality of individual box outs areas that are spaced apart in the transverse direction such that a portion of the concrete base extends in the lengthwise direction between at least two of the box-out areas in the set. Moreover, multiple sets of lengthwise cable segments are also suspended within the concrete base. In particular, each set of lengthwise cable segments comprises a plurality of lengthwise cable segments arranged in series and extending in a lengthwise direction such that each set of lengthwise cable segments extends about the footprint at a respective position between the inner edge and the outer edge. Also, the series of lengthwise cable segments in each set are joined end to end in respective box-out areas thereby defining respective lengthwise cable structures that extend continuously about an entire circumferential length of the concrete base in the lengthwise direction.

According to another aspect, a method of constructing a post-tensioned running track is provided. In particular, the method beings by arranging, within a predefined footprint of a base, multiple sets of lengthwise post-tensioning cable segments. More specifically, each set comprises a plurality of lengthwise cable segments arranged in series and extending in a lengthwise direction such that each set of lengthwise cable segments extends about the footprint at a respective position between an inner edge and an outer edge of the footprint. The method also includes the step of forming a concrete base structure. In particular, the concrete base structure is formed around the sets of lengthwise cable segments such that free opposing ends of successive cable segments of each set are disposed within a discrete respective void formed in the concrete base structure. Moreover, the respective voids are formed within the concrete base structure such that they are spaced apart from any adjacent respective voids in the transverse direction. In addition, the method includes the step of, for each set of lengthwise cable segments, joining the lengthwise cable segments in series in respective voids thereby defining a respective lengthwise cable structure that extends continuously about an entire circumferential length of the base. In addition, the method includes the step of performing a partial tensioning of the lengthwise cable segments and then performing a final tensioning of the lengthwise cable segments. Finally the method includes the step of filling the voids with concrete thereby surrounding respective joined lengthwise cable segments disposed therein with concrete.

These and other aspects, features, and advantages can be appreciated from the accompanying description of certain embodiments of the invention and the accompanying drawing figures and claims.

DETAILED DESCRIPTION OF CERTAIN EMBODIMENTS OF THE INVENTION

Figure 1:
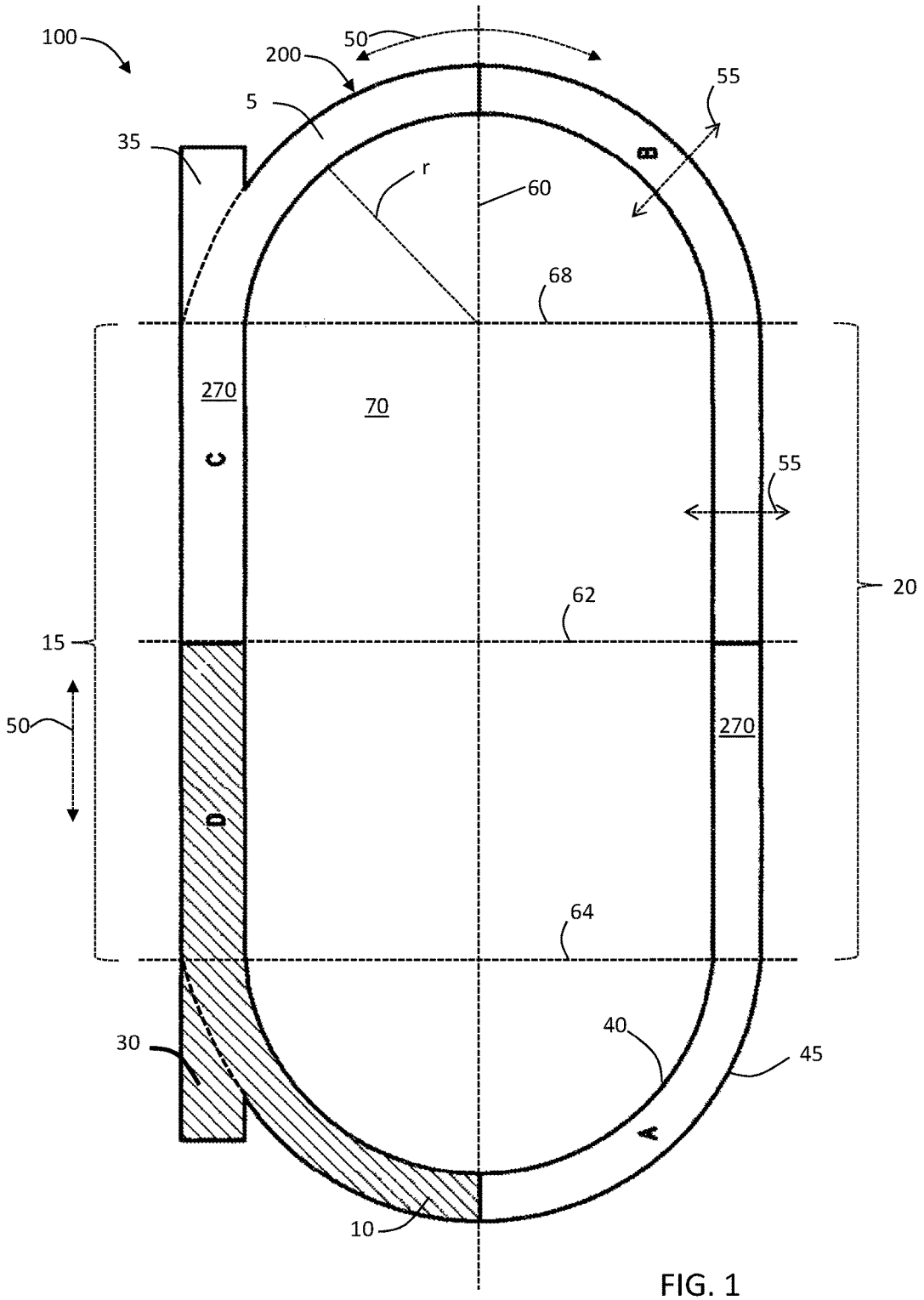
FIG. 1 illustrates a top plan view of a running track constructed in accordance with one or more of the disclosed embodiments.

By way of overview and introduction, disclosed herein is a running track design and method of construction using post-tensioning to reinforce the base structure of the track. The exemplary running track structures further described herein include a reinforced concrete base that is poured to form a flat slab base having a generally oval shaped footprint surrounding a central area. The reinforcement of the concrete base is provided by, inter alia, un-bonded post-tensioning cables that are arranged within the footprint of the track prior to pouring the concrete base and such that they are suspended within the base after placement of the concrete base. In particular, the post-tensioning cables include a plurality of transverse cables and a plurality of lengthwise cables. The transverse cables extend within the base between an inside edge of the base and a corresponding outside edge of the base that (i.e., extend directly across the width of the base at respective locations). Moreover, the transverse cables can be provided at generally evenly spaced intervals such that they are located throughout the base structure and can be tensioned to exert compressive forces on the base in the transverse direction.

In addition to the transverse cables, a plurality of lengthwise post-tensioning cables are also suspended within the concrete base. The lengthwise cables are cable structures that extend in the lengthwise direction through the base for an entire circumferential length of the track. It should be understood that the term "lengthwise" or "lengthwise direction," as used herein, refers to the direction that the flat slab base extends at any given point along the base. For instance, the base extends linearly in the rectangular side areas and arcuately in the curved end areas, referred to as turns. According to a salient aspect, each lengthwise cable structure is defined by a series of lengthwise cable segments that are connected end-to-end to define a continuous loop and then tensioned. The lengthwise cable segments are also positioned within the base such that they are spaced apart across the width of the base. The continuous nature of the lengthwise cables provides compressive forces on the concrete base acting in the lengthwise direction that are continuous throughout the entire circumferential length of the cable. The spacing of the lengthwise cables across the width of the track facilitates distribution of such forces across the width of the track.

According to a further salient aspect, the lengthwise cable segments begin and end in box-out areas of the base that are strategically spaced apart around the base. In particular, sets of forms that define the box-out areas are placed at various locations around the track. The sets of box-outs are spaced apart such that the lengthwise cable segments extending between successive sets of box-outs have generally the same length. Accordingly, the ends of successive lengthwise cable segments are exposed within respective box-outs and can be joined end-to-end to define the continuous lengthwise cable structures. In addition, the connected lengthwise cable segments can be tensioned within the box-outs such that each continuous lengthwise cable structure has a relatively consistent tension along its entire length and exerts a prescribed compressive force on the base of the track in the lengthwise direction. According to a salient aspect, the compressive force exerted by the so configured lengthwise cables on the base of the track is continuous and uninterrupted throughout the entire length of the base.

According to a further aspect, the set-apart placement of the box-outs in each set allows concrete, which forms the primary structure of the track base, to be poured in-between and/or around the box-outs so as to form a base structure that extends substantially uninterrupted in the lengthwise direction between the box-outs in the set while still leaving the areas isolated by the box-outs and the ends of the lengthwise cable segments uncovered by concrete and exposed. Accordingly, the main portion of the base that extends the entire circumferential length of the track can be formed and that entire structure can be reinforced by tensioning the transverse and lengthwise post-tensioning cables at various stages during the concrete curing process. Finally the box-out areas can be filled with concrete to complete the concrete base structure.

The exemplary embodiments of post-tensioned running tracks, as further described herein, including the arrangement of post-tensioning cables, the configuration of the concrete base formed around the post-tensioning cables and the exemplary methods for constructing the track provide a more efficient track design in terms of structural integrity (e.g., resistance to cracking and deformation) and also achieves efficiencies relating to installation and construction.

The referenced systems and methods for providing a post-tension running track are now described more fully with reference to the accompanying drawings, in which one or more illustrated embodiments and/or arrangements of the systems and methods are shown. The systems and methods are not limited in any way to the illustrated embodiments and/or arrangements as the illustrated embodiments and/or arrangements described below are merely exemplary of the systems and methods, which can be embodied in various forms, as appreciated by one skilled in the art. Therefore, it is to be understood that any structural and functional details disclosed herein are not to be interpreted as limiting the systems and methods, but rather are provided as a representative embodiment and/or arrangement for teaching one skilled in the art one or more ways to implement the systems and methods.

FIG. 1 illustrates a top plan view of an exemplary running track 100 constructed in accordance with one or more of the disclosed embodiments. The running track 100 includes a substantially flat concrete slab base structure 200 that has a generally oval-shaped footprint that surrounds a center area 70. The center area 70 is commonly reserved for a grass or artificial turf field area that is used to play a variety of field sports. As shown in FIG. 1, the base of the track is comprised of two opposing turns 5 and 10 that are generally semi-circular in shape. In addition, two opposing elongate rectangular side areas, 15 and 20, connect the two turns to complete the continuous base of the running track.

The base of the track has an inner edge 40 and an outer edge 45 that define the width of the base there-between. In this exemplary configuration, the inner edge and outer edge extend generally parallel to one another for most of the circumferential length of the track. Accordingly, the width of the running track, when measured in a transverse direction 55 (i.e., the direction that is perpendicular to the inner edge and extends directly across the base toward the outer edge), is generally consistent throughout most of the length of the track. As would be understood by those in the art, the term "length of the track" or "circumferential length" is generally used herein to refer to the distance required to travel along the track in the lengthwise direction 50 starting and ending at a start/finish point and while maintaining a consistent distance (in the transverse direction) away from the inner edge of the track. Due to the oval shape of the track the length of the track is smallest at the inner edge and is greater if measured while maintaining a position on the track that is further away from the inner edge and toward the outer edge.

The turns 5 and 10 and the side areas 15 and 20 are generally co-planar so as to provide a top surface 270 of the running track that is generally flat and level. However, the base of the running track need not be entirely flat, for instance, the base can be sloped from the outer edge to the inner edge for drainage purposes. The concrete base of the track also has a thickness (not shown) that extends between the top surface and an opposing bottom surface (not shown)

at respective locations on the track. For example and without limitation, the thickness of the exemplary concrete base further described herein is about four and a half inches (4½") through most of the length of the track, however, a base having different thicknesses can be provided without departing from the scope of the disclosed embodiments of the invention.

Although the thickness of the base is generally consistent throughout the length of the track, the thickness of the base can vary at various locations while still providing a level top surface. For instance, in some implementations, the concrete base can be formed to include one or more structural beams or "haunches" (not shown). A haunch is a portion of the base that is thicker (i.e., extends deeper into the ground/sub-base) than the remainder of the generally uniform slab. In one exemplary implementation, the base can be configured to include a one foot wide by two feet deep haunch extending at or near the outside edge 45 of the base along a substantial portion of a turn. The thicker haunch structure extending into the sub-base beneath the base 200 along the outside edge of the track provides additional weight and added stiffness to the base throughout the turn and resists lifting and/or movement of the turn of the base towards the center of the track when the lengthwise cables are tensioned. Preferably, a haunch is provided at the outside edge of each turn, however, in addition or alternatively, a haunch can be similarly provided near the inside edge of the turn.

In addition, the base of the track can also include one or more keyway structures (not shown) disposed therein. As would be understood by those in the art, concrete shrinks during the curing process and, depending on the size, thickness and shape of a concrete slab, shrinkage from curing can result in formation of shrinkage cracks. In one or more implementations, six (6) keyways can be generally evenly spaced apart within the footprint of the base prior to concrete placement to mitigate shrinkage cracking. More specifically, the keyways are thin, elongate metal structures configured to extend across the width of the base 200 at respective locations and sized to extend through much of the thickness such that a thin top-surface layer of concrete (e.g., ½" inch of coverage) covers each keyway after concrete placement. The keyways can also be configured to include holes or slots such that the lengthwise cables within the base can extend uninterrupted through the keyways. The keyways serve to localize stresses caused by shrinkage and, accordingly, localize shrinkage cracking to the portion of concrete directly above the keyway (e.g., in a straight line across the width of the base) and avoids shrinkage cracks forming at random locations in the base during curing. Accordingly, the tensioning of the lengthwise post-tensioning cables at various stages during and after the concrete base cures, as further described herein, will serve to pull the concrete on both sides of any such cracks back together thereby providing a top surface layer of concrete that is effectively devoid of cracks. It should be understood that the number of keyways that are used and their placement within the base can depend on the particular size and configuration of the base.

As shown in FIG. 1, the turns 5 and 10 of the running track have a semi-circular or "arch-shaped" configuration, with a consistent radius of curvature (i.e., shown as "r" in FIG. 1) around the turn. However, in some implementations, extension areas can also be provided near one or more ends of a turn. Extension areas are commonly used for sprint running events that require a linear length of track that is greater than the length of a rectangular side area (e.g., 15 or 20). For example, as shown in FIG. 1, extension areas 30 and 35 are provided near the intersection of the turns and side area 15 and, effectively, provide a linear extension of the rectangular side area 15.

In addition or alternatively to having extension areas that extend a linear length of the track, in some implementations, one or more portions of the base can also be extended in the transverse direction (i.e., width-wise) so as to provide a track that is wider in certain areas than others. For instance, in the exemplary configuration shown in FIG. 1, the width of the linear portion of track extending between the ends of extension areas 35 and 30 can be wider than the remaining portions of the track. Although the base of the track is described herein as having a generally oval shaped footprint and a width that is generally consistent around most of the track, the width and the relative position of the inside and outside edges of the track can vary depending on the particular layout of the track.

As shown in FIG. 1, the track is generally symmetrical across a vertical axis 60 bifurcating each of the turns 5 and 10 (i.e., symmetrical except for the extension areas or other variations in the track footprint local to a particular area of the track). In addition, as shown, the base 100 is also generally symmetrical across a horizontal axis 62 that bifurcates the side areas 20 and 15. Although the exemplary track 100 has been described as being comprised of two opposing turns 5 and 10 and two opposing rectangular side areas 15 and 20, as shown in FIG. 1 and further described herein, portions of the exemplary track are also further described herein in terms of quadrants A, B, C and D, wherein each quadrant has one end at the apex of one of the turns 5 or 10 and an opposite end at the mid-point of one of the side areas 15 or 20. An exemplary configuration of the running track 100 in quadrants A, B, C and D is illustrated in greater detail in FIGS. 4A-4D and further described herein. Collectively, these figures cover the entire footprint of the running track 100 and illustrate an exemplary configuration of post-tensioning cables, box-outs and other design features in accordance with one or more of the disclosed embodiments of the invention.

The exemplary configuration of the running track 100 that is described herein is provided by way of example and without limitation. Variations in the footprint of the track (e.g., different size, overall shape, length, width of the sides/ends, radius of the end-portions, length of rectangular side areas or turns, placement and sizing of extension areas, and the like) can be realized without departing from the scope of the disclosed embodiments of the invention. The exemplary configuration and method of constructing a post-tensioned running track having post-tensioning cables in accordance with one or more embodiments of the present invention is further described herein with continued reference to the exemplary running track 100 shown in FIG. 1.

Figure 4A:
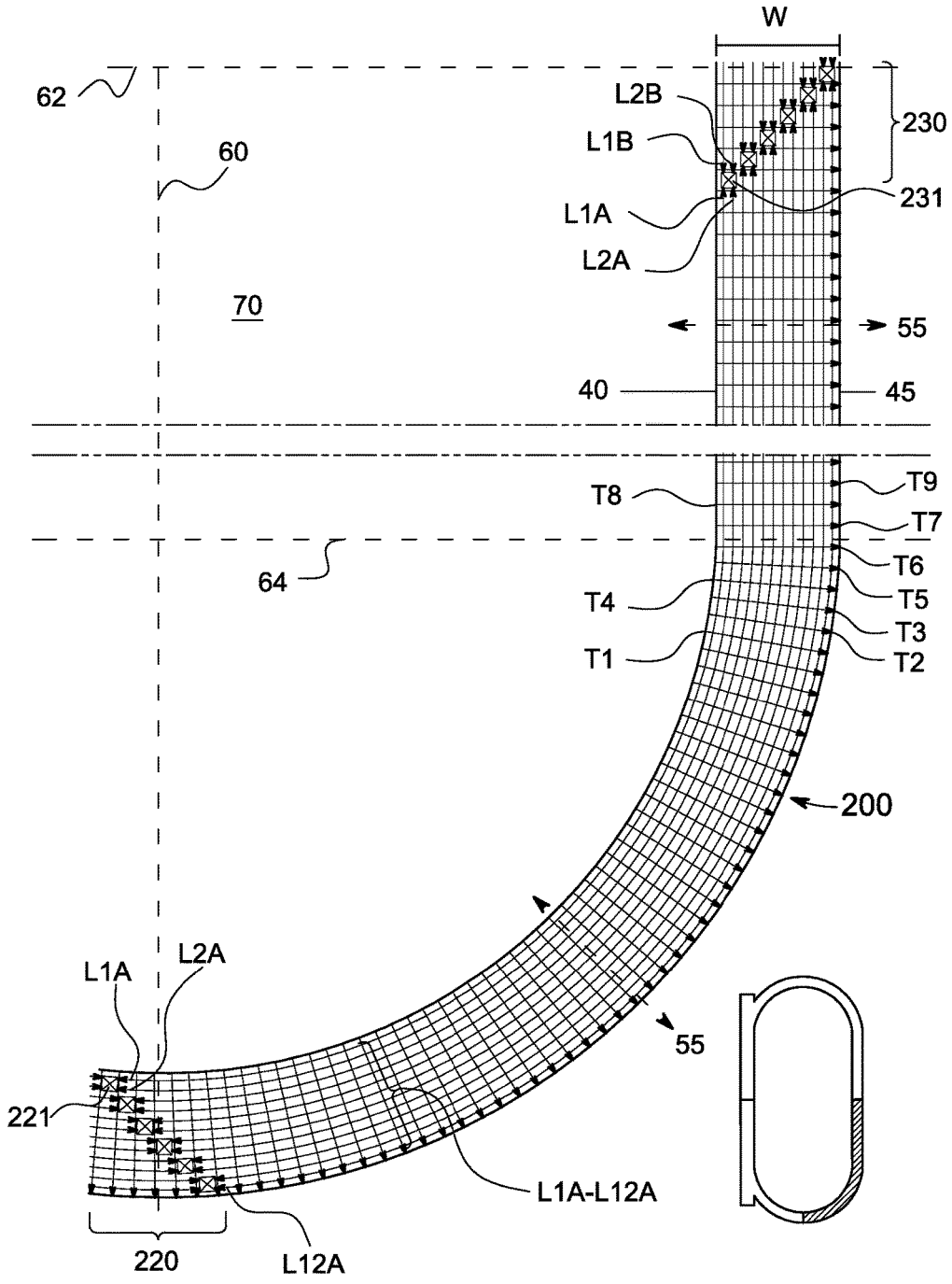
FIG. 4A illustrates a detailed top plan view of a portion of the exemplary running track of FIG. 1 constructed in accordance with one or more of the disclosed embodiments.
Figure 4B:
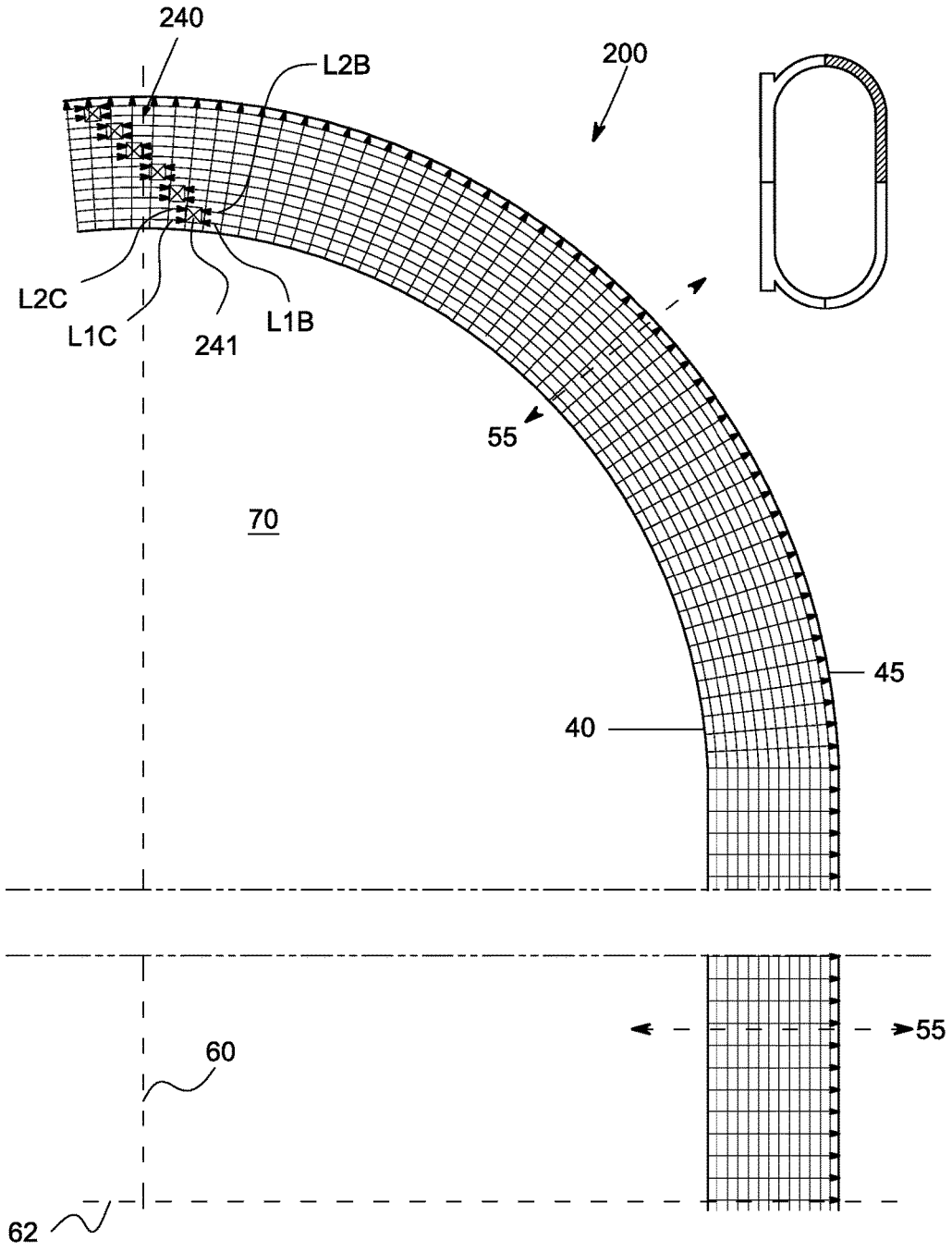
FIG. 4B illustrates a detailed top plan view of a portion of the exemplary running track of FIG. 1 constructed in accordance with one or more of the disclosed embodiments.
Figure 4C:
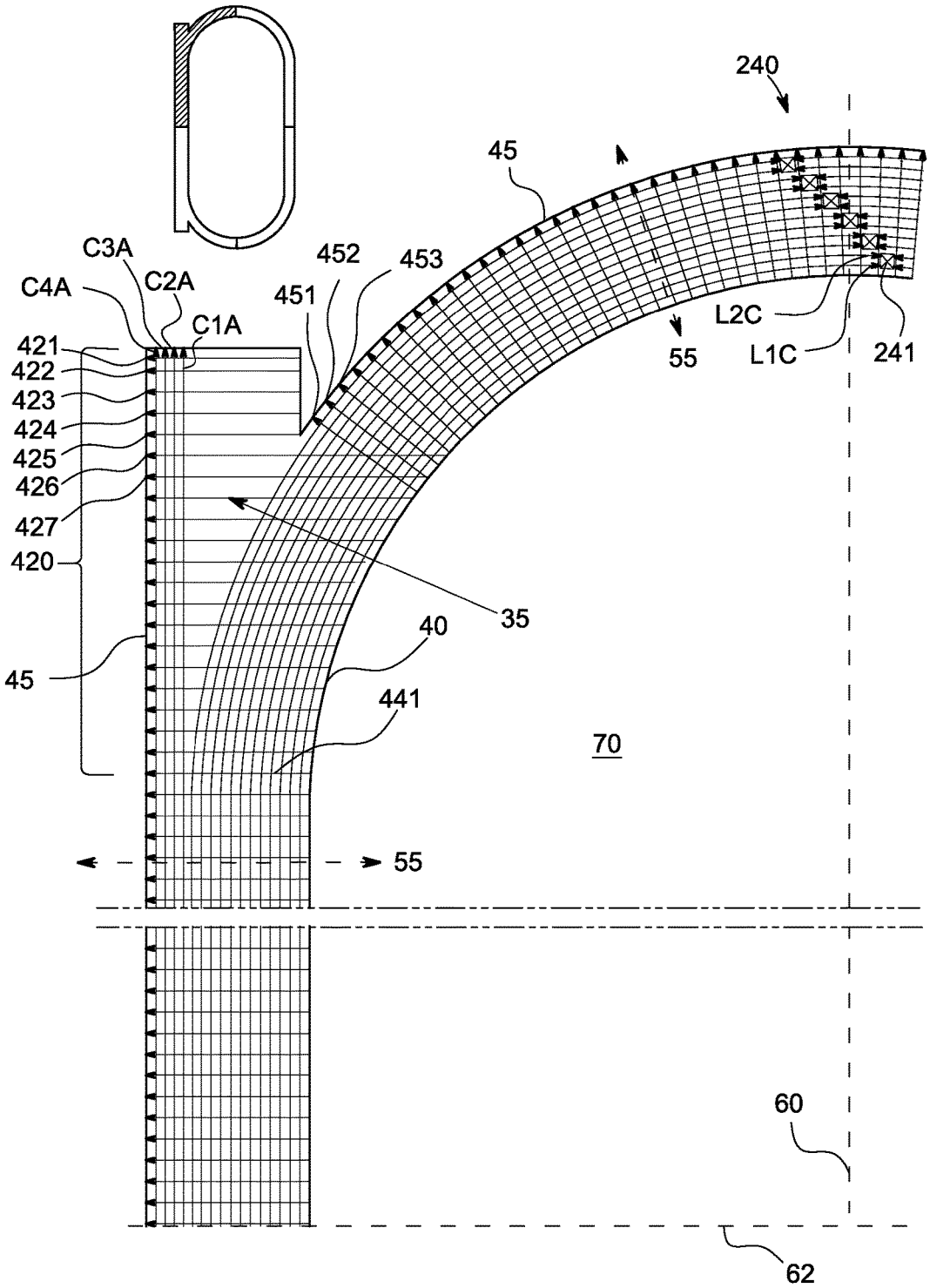
FIG. 4C illustrates a detailed top plan view of a portion of the exemplary running track of FIG. 1 constructed in accordance with one or more of the disclosed embodiments.
Figure 4D:
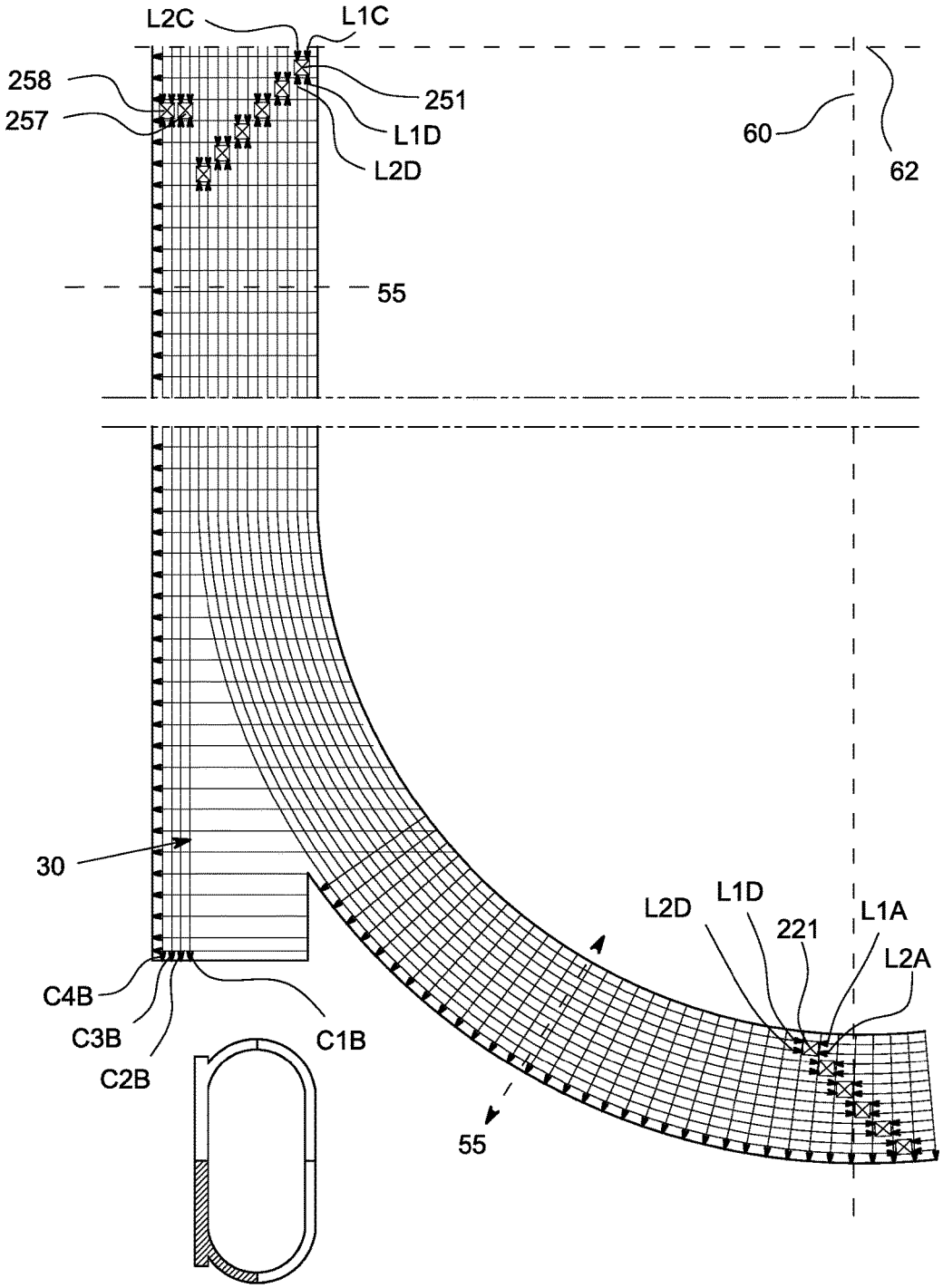
FIG. 4D illustrates a detailed top plan view of a portion of the exemplary running track of FIG. 1 constructed in accordance with one or more of the disclosed embodiments.

As shown in FIG. 4A, which depicts quadrant A of the track 100, the base 200 of the running track includes at least two sets of cables therein. A first set of cables referred to as "transverse cables" are disposed within the base and oriented generally in the transverse direction 55 such that the transverse cables extend across the width of the track in a generally perpendicular fashion from the inside edge 40 to the opposing outside edge 45. For simplicity, only a representative subset of transverse cables, namely, T1-T9, are specifically identified in FIG. 4A. However, transverse cables are similarly suspended within the base throughout the entire length of quadrant A. Similarly, FIGS. 4B-4D provide a detailed top-plan view of quadrants B, C and D of the running track 100, respectively, and depict exemplary arrangement of transverse cables in each of said quadrants in accordance with one or more of the disclosed embodiments of the invention. The top surface of the base has been cut-away in FIGS. 4A-5D to more clearly show the configuration of the post-tensioning cables suspended within the base and box-out areas, as further described herein.

In one exemplary configuration, one-half inch (½") diameter, seven (7) strand un-bonded post-tensioning cables are used for the transverse cables. In addition or alternatively, cables having a different thickness or strand count can be used. Un-bonded post-tensioning cables include a metal cable core and a polymer outer sheath and are configured to allow the cable core to move linearly within the sheath. Accordingly, the sheath allows the cable to be tensioned after the concrete base is poured around the cable and minimizes resistance that would otherwise result if a bonded post-tensioning cable (i.e., an unsheathed cable) was used. As further described below, tensioning the so oriented transverse cables exerts a compressive force on the concrete base 200 that is acting in the transverse direction 55 localized at respective locations of the transverse cables. Due to the transverse orientation of the transverse cables and the lengthwise orientation of the lengthwise cables, the lengthwise and transverse cables can be generally perpendicular to one another.

Preferably, the transverse cables are laid out such that they are generally coplanar within the base 200. It is also preferable that the post-tensioning cables are generally on a plane within the base that bisects the thickness of the slab (i.e., is generally halfway between the top surface of the base and the bottom surface) such that the compressive forces exerted by the post-tensioning cables are generally evenly distributed through the thickness of the base. It is also preferable for the transverse cables to be generally consistently spaced apart from one another. Consistent depth and spacing of the transverse cables can promote uniformity in the compressive forces on the concrete base after tensioning. However, as further described herein, the particular spacing, orientation and length of the post-tensioning cables can vary depending on the particular footprint of the base in a given area.

The particular spacing of the transverse cables in a given area can be defined as a function of the width of the track and the desired compressive forces on the track. In addition, the particular orientation of the cables within the base can also be defined as a function of the desired compressive forces on the base in respective areas and the width and/or the footprint of the base at respective locations of the transverse cable(s). For example, as shown in FIG. 4A, the spacing of transverse cables in the linear, rectangular side portion of the track (e.g., cables T6-T9) is consistent and the cables run parallel to one another from the inside edge 40 and the opposing outside edge 45. The transverse cables in the curved turns (e.g., T1-T4) are generally evenly spaced apart, as well. However, it should be noted that the spacing and relative orientation of the cables can vary. For example, the transverse cables in the curved turn (e.g., T1-T4) are not necessarily parallel due to the radius of curvature of the inside edge 40 of the track and the path of the opposing outside edge 45 in that area of the track. Moreover, although the transverse cables have consistent spacing and run almost parallel to one-another throughout most of the curved end portion, cables located near the intersection of the curved turn and linear side area (e.g., cables T4 and T5) can have a spacing and/or relative orientation that varies more substantially.

Any number of conventional anchoring means can be used to anchor post-tensioning cables to the base including but not limited to mechanical fasteners known in the art as "dead-end anchors" and "live-end anchors." In one implementation, a dead-end anchor (not shown) that is configured to receive a proximal end of a single transverse cable therethrough can be provided near the side of the base at a location along the inside edge 40. For instance, the dead-end anchor can be embedded within the concrete base structure at or near its inside edge. The dead-end anchor fixedly engages the transverse cable at or near its proximal end thereby anchoring it to the side of the base. In some implementations, the opposing free end of the same transverse cable can be anchored to the opposing side of the base (i.e., at a corresponding location along the outside edge 45) using a live-end anchor (not shown). The live-end anchor is a device that is configured to receive the opposing free end of the transverse cable therethrough and allows the cable to be pulled through the anchor away from the opposite end. Live-end anchors can also accommodate or include a locking mechanism (e.g., a cam-lock or a wedge) that allows a cable to be pulled therethrough so as to adjust the tension on the cable (also referred to as "stressing" the cable) and prevents the cable from relaxing or retracting back towards the opposite anchored end. Accordingly, during the post-tensioning process, the free end of each transverse cable that extends through a live anchor can be pulled using a tensioning device so as to stress the cable and the live-anchor locks the cable to maintain the tension on the cable and, thus, maintain the compressive force on the surrounding area of the base. Various alternative methods for anchoring and tensioning the transverse post-tensioning cables can be applied without departing from the scope of the disclosed embodiments of the invention, for instance, live anchors can be used on the interior edge of the track and a dead-end anchor at the opposite outside edge, multiple live anchors can be used or alternative anchoring devices can be used.

Figure 2:
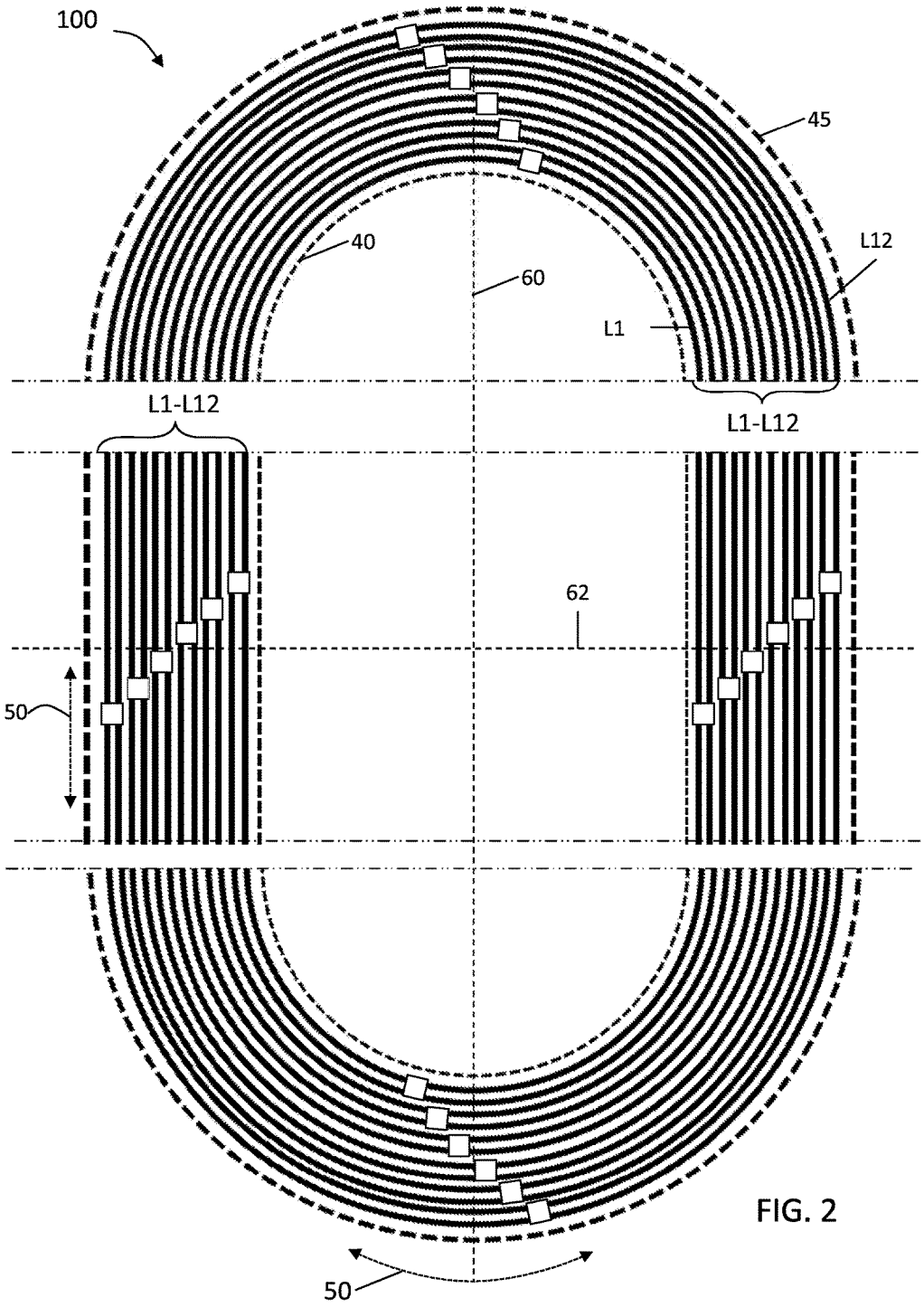
FIG. 2 illustrates a simplified top plan view of an exemplary running track constructed in accordance with one or more of the disclosed embodiments.

According to a salient aspect, a plurality of lengthwise cables are also disposed within the base 200. Similar to the transverse cables described above, these lengthwise cables are also laid out within the footprint of the base prior to pouring the concrete that forms the main structure of the base. Turning briefly to FIG. 2, FIG. 2 is a simplified diagram of the track 100 and does not show any extension areas so as to isolate only the main oval portion of the base. FIG. 2 depicts lengthwise cables L1-L12 that are disposed within the base and extending lengthwise through the base such that the lengthwise cables L1-L12 extend around the entire circumferential length of the base thereby forming continuous loops of cable.

Preferably, the lengthwise cables are evenly spaced apart across a substantial portion of the width of the base (i.e., in the transverse direction 45). It is also preferable that each lengthwise cable extends in the lengthwise direction 50 through the base for the entire length of the track at a generally consistent distance from the inside edge 40 (or similar reference point(s)). Accordingly, the lengthwise cables form concentric oval-shaped loops that follow the generally oval-shaped footprint of the base. The particular number of lengthwise cables and their respective position within the base and relative spacing between cables (i.e., the distance between adjacent lengthwise cables within the base in the transverse direction) can depend on a number of factors. These factors include, without limitation, the width of the base, the overall length of the base and the required compression in the base. As shown in FIG. 2, twelve lengthwise cables L1-L12 are provided within the base 200.

Preferably, the lengthwise cables are suspended within the base at a depth such that they are generally co-planar to one-another. It is further preferable that the lengthwise cables generally extend on a plane that bisects the thickness of the slab (i.e., halfway between the top surface of the base and the bottom surface). However, in addition or alternatively, one or more of the lengthwise cables can be placed at different depths within the base. Moreover, the depth of an individual lengthwise cable within the base can vary at different locations along its length. For example and without limitation, because the lengthwise cables can be laid out on-top of the transverse cables, as further described below, and the post-tensioning cables are all arranged to be suspended within the base approximately halfway between the top and bottom surface, the depth of the lengthwise cables within the base (and/or the transverse cables for that matter) can increase where lengthwise cables and transverse cables intersect. Because the lengthwise cables are installed on top the transverse cables, the lengthwise cables and transverse cables extend in a generally co-planar fashion and are not exactly co-planar. Moreover, in some implementations, the depth of the cables within the base can also change in or around the "box-out" areas where segments of cable are joined end to end.

As noted above, each loop of lengthwise cable can be comprised of a series of individual lengthwise cable segments that extend through respective portions of the base and are connected end-to-end to define a continuous lengthwise cable structure referred to as a continuous lengthwise cable. The exemplary configuration of the lengthwise cable segments that define continuous lengthwise cables will be further appreciated with reference to FIGS. 4A-4D, which depict lengthwise cable segments L1A-L12A, L1B-L12B, L1C-L12B and L1D-L12D extending through quadrants A, B, C and D of the base 200 of track 100, respectively.

Preferably, each of the lengthwise cable segments originate and terminate in areas within the base 200 referred to as box-outs. Each individual box-out is a discrete portion of the base that is isolated from the surrounding area, for example using a concrete form or box, during the initial pouring of the concrete base so as to provide a void that is later filled with concrete.

The box-outs can be arranged in groups/sets that are strategically located about the base such that there is a generally even distance between successive sets of box-outs. The particular number of box-out sets within the base and the particular location of each set can be a function of a number of factors. These factors include, for example and without limitation, the length of the track, the width of the track, the particular configuration of the lengthwise post-tensioning cables (e.g., the number of cable segments that define a lengthwise cable loop, spacing, a tensile strength of the individual segments, as well as the desired compressive force on the slab in the lengthwise direction). More specifically, the number of lengthwise cable segments that define a continuous cable structure and where they begin and end within the base can be defined according to, inter alia, a) the overall length of the track, b) the amount of tension desired for the continuous lengthwise cable structure, c) the amount and uniformity of tension that can be placed on each lengthwise cable segment in view of the frictional forces on the cable given the path of the cable within the base (e.g., factoring in whether the cable segment extends at least partially through a curved turn of the base).

In the exemplary configuration of the base 200 shown in FIGS. 4A-4D, four sets of box-out areas 220, 230, 240 and 250 are located around the track and have generally even distance between successive sets of box-outs. In particular, box-out set 220 is located at the intersection of quadrants D and A (shown in FIGS. 4A and 4D), which corresponds to the apex of turn 10; box-out set 230 is located near the intersection of quadrants A and B (shown in FIG. 4B), which corresponds to the midpoint of side area 20; box-out set 240 is located near the intersection of quadrants B and C (shown in FIGS. 4B and 4C), which corresponds to the apex of turn 5; and box-out set 250 is located near the intersection of quadrants D and C (shown in FIG. 4D), which corresponds to the midpoint of side area 15. Close-up top-plan views of the box-out sets 230, 240, 250 and 260 and the surrounding areas of the base 200 are also provided in FIGS. 5A-5D, respectively.

In the exemplary implementation, the four sets of box-outs are placed near the apex of both turns and the midpoint of the side areas such that the lengthwise cable segment defining a lengthwise cable structure are each relatively equal in length and extend through approximately half of a turn and half of a linear side area. Individual lengthwise cable segments exert forces on the base that can vary along the length of the cable segment, for instance, as a function of the particular path (e.g., curvature) of the cable segment within the base. However, the similar configuration shared by individual lengthwise cable segments that define a particular lengthwise cable structure results in consistent compressive forces on the base relative to one-another. As between the different continuous lengthwise cable structures within the base, the similar configuration of the continuous lengthwise cables promotes consistency in the compressive forces that they exert on the base. However, it should be understood that different continuous lengthwise cables perform work on different areas of the base. For instance, the continuous lengthwise cable structure L12 positioned closest to the outer edge 45 of the track works on almost the entire base structure that lies towards the inside edge of that cable, whereas the work provided by the innermost continuous lengthwise cable L1 is generally localized to the ring of the base that is to the inside of that innermost cable.

In some implementations, a box-out set need not be located entirely within a particular quadrant and can extend from one quadrant into the ensuing quadrant. For example, FIG. 4A depicts individual box-outs in box-out set 220 that are located on one side of the vertical axis 60 (e.g., box-out 221 is located in quadrant D) whereas other box outs (e.g., box-out 226) are located in the adjacent quadrant A. By way of further example, as shown in FIG. 4A, box-out set 230, which is located at the opposite end of quadrant A, does not extend over the horizontal axis 62 into the adjacent quadrant B.

Figure 5A:
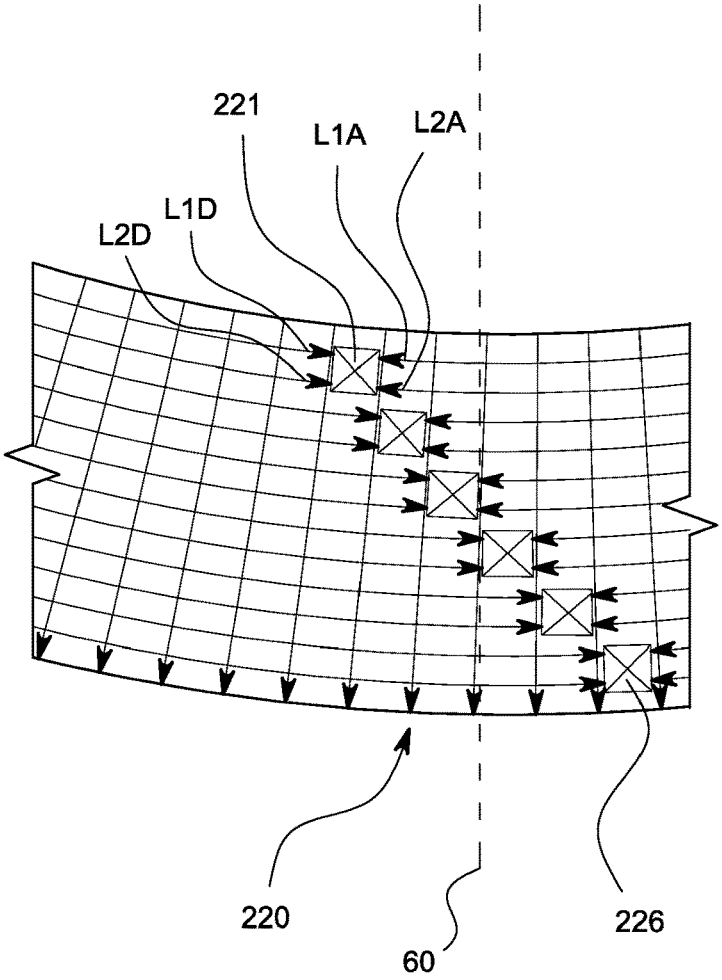
FIG. 5A illustrates a detailed top plan view of a portion of the exemplary running track of FIG. 1 constructed in accordance with one or more of the disclosed embodiments.

As noted above, preferably, each set of box outs is comprised of a plurality of individual box-outs. For instance, as shown in FIGS. 4A and 5A, box out set 220 is comprised of individual box outs 221-226. It is further preferable that one or more of the box-outs in a set are set apart from one-another in the transverse direction (e.g., across the width of the track). For instance, in the exemplary configuration of box-outs in set 220, at least six inches of spacing in the transverse direction is provided between adjacent box-outs. Also, preferably, the box-outs located closest to the inner or outer edge are set in from the inner edge 40 towards the middle of the base such that all box-outs are surrounded by the concrete base formed during the initial pouring of the base.

Due to the set-apart spacing of box outs in the transverse direction, the concrete forming the base structure can be poured in-between and around the box-outs. As a result, the base structure formed around the voids provided by the box-outs in each set has continuity in the lengthwise direction thereby providing structure and stiffness to the base around the box-outs in the lengthwise direction, such that the lengthwise cables can be tensioned, despite the voids provided by the box-outs.

According to a further salient aspect, preferably, one or more of the individual box-outs in a set are spaced-apart (i.e., "staggered") in the lengthwise direction. For instance, the box outs in set can be staggered such that at least six inches of spacing in the lengthwise direction is provided between adjacent box-outs. Staggering of the box-out areas in the lengthwise direction results in the formation of a concrete base structure in which one or more portions extend directly across the width of the track in-between one or more of the box-outs in the set.

Figure 5B:
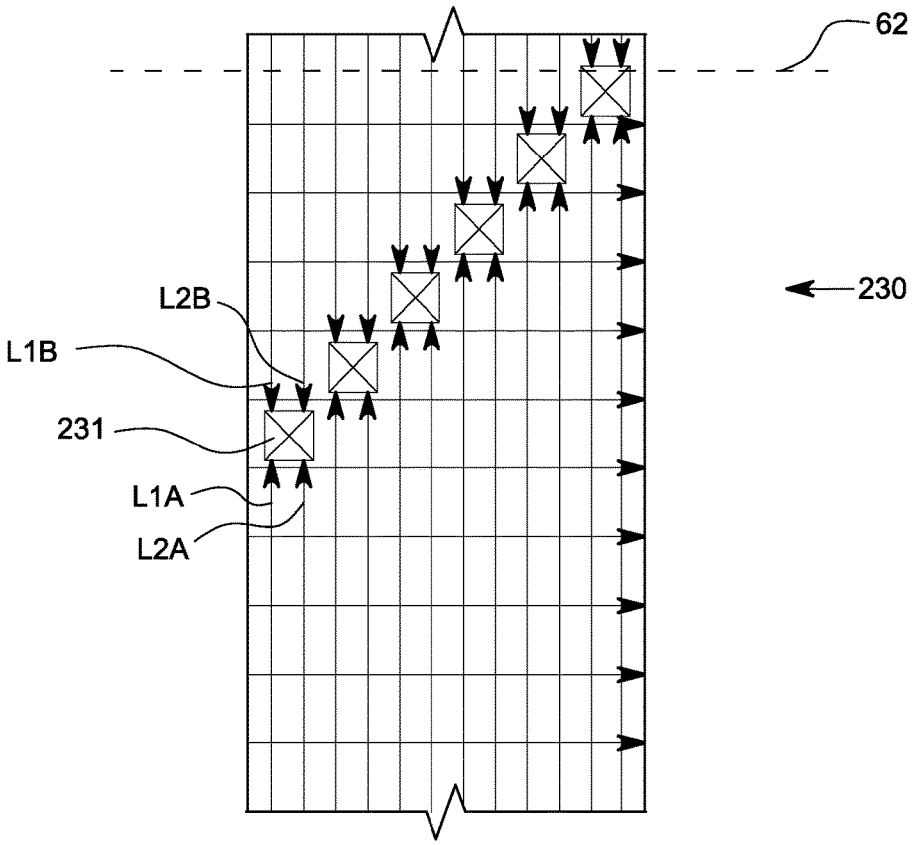
FIG. 5B illustrates a detailed top plan view of a portion of the exemplary running track of FIG. 1 constructed in accordance with one or more of the disclosed embodiments.
Figure 5C:
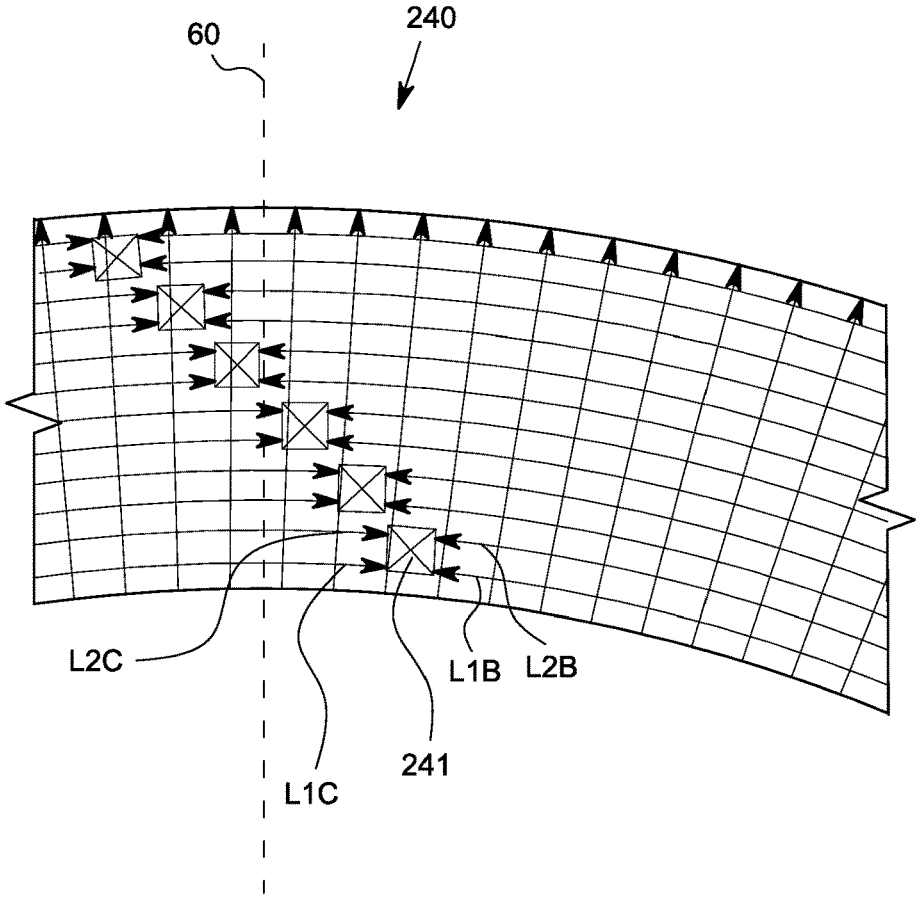
FIG. 5C illustrates a detailed top plan view of a portion of the exemplary running track of FIG. 1 constructed in accordance with one or more of the disclosed embodiments.

Another factor that can guide the location of the box-outs in a set and the staggered spacing there-between is the location of any transverse cables. For instance, the box-outs can be staggered in the lengthwise direction such that at least one transverse cable extends across the width of the base through the area between two of the box-outs. FIGS. 5A and 5B further illustrate the spacing of the box-outs in sets 220 and 230 in the transverse direction (across the width of the track). Also shown is the spacing of the box-outs in the lengthwise direction, which also allows for the initial formation of the concrete base structure in between the box-outs such that transverse cables (identified as S-26) suspended within the concrete base extend directly across the width of the track in between neighboring box-outs in the set. This exemplary configuration of box-outs and transverse cables can further improve the structural integrity of the base in the area surrounding the box-out set, for instance, by providing stability in the transverse direction. By way of further example, FIG. 5C illustrates an exemplary arrangement of the box-outs in set 240 that are spaced apart in the lengthwise and horizontal direction, as described above. Moreover, FIG. 5C also illustrates an exemplary configuration of the box-outs and transverse cables (identified as S-26) in which one or more of the transverse cables extend through the area of the box-out areas, as opposed to extending in the spacing between adjacent box-out areas.

Ultimately, the staggered and spaced apart placement of the individual box outs in each set results in a concrete base structure formed around the box-outs that has an area and volume that is substantially greater than the volume of the voids within the base provided by the box-outs. Moreover, the continuity of the base structure in between and around the box outs in the lengthwise direction and/or transverse direction further contributes to the structural integrity of the base by providing stability in the lengthwise, transverse and/or torsional directions even prior to tensioning the post-tensioning cables.

Figure 5D:
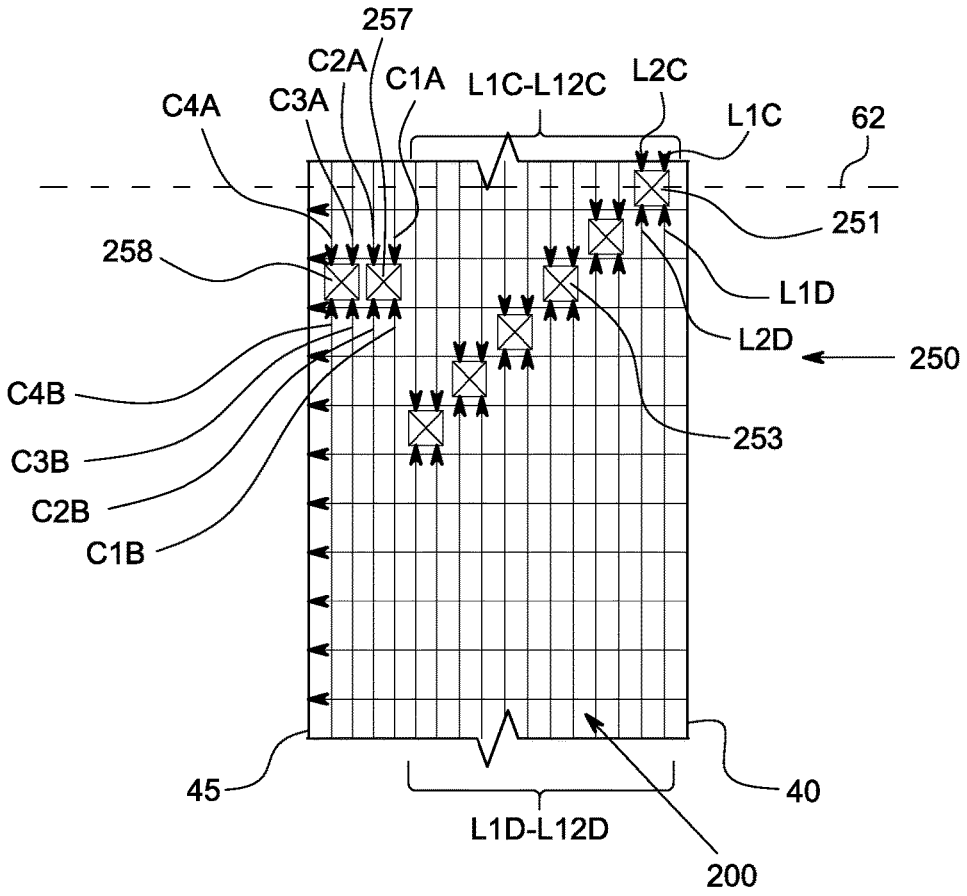
FIG. 5D illustrates a detailed top plan view of a portion of the exemplary running track of FIG. 1 constructed in accordance with one or more of the disclosed embodiments.

Returning now to FIG. 4A, as previously noted, each loop of lengthwise cable can be comprised of a series of individual lengthwise cable segments that extend through respective portions of the base and are connected end-to-end in a box-out area to define a continuous post-tensioned loop of cable extending completely around the length of the base. In addition, each connection point between two successive lengthwise cable segments provides a stressing point for the individual cable segments and the continuous lengthwise cable structure as a whole. For instance, as shown in FIG. 4A, lengthwise cable segments L1A-L12A extend between box-out set 220 and box-out set 230 near the opposite end of quadrant A. More specifically, FIGS. 4A and 5A show, for example, the lengthwise cable segments L1A and L2A originating in box-out 221 and terminating at box-out 231. FIGS. 4A and 5C depict lengthwise cable segments L1B and L2B originating in box-out 231. FIGS. 4B and 5C, show the segments terminating in box-out 241. FIGS. 4B, 4C and 5C also show lengthwise cable segments L1C and L2C beginning at box-out 241. FIG. 4D and FIG. 5D show lengthwise cable segments L1C and L2C terminating at box-out 251 and lengthwise cable segments L1D and L2D beginning at box-out 251. FIG. 4D and FIG. 5A further depict lengthwise cable segments L1D and L2D terminating at box-out 221. As shown in FIGS. 4A-5D that the remaining lengthwise cables (i.e., L3-L12) are configured to extend continuously around the base in a similar fashion as lengthwise cables L1 and L2 described above.

Figure 3A:
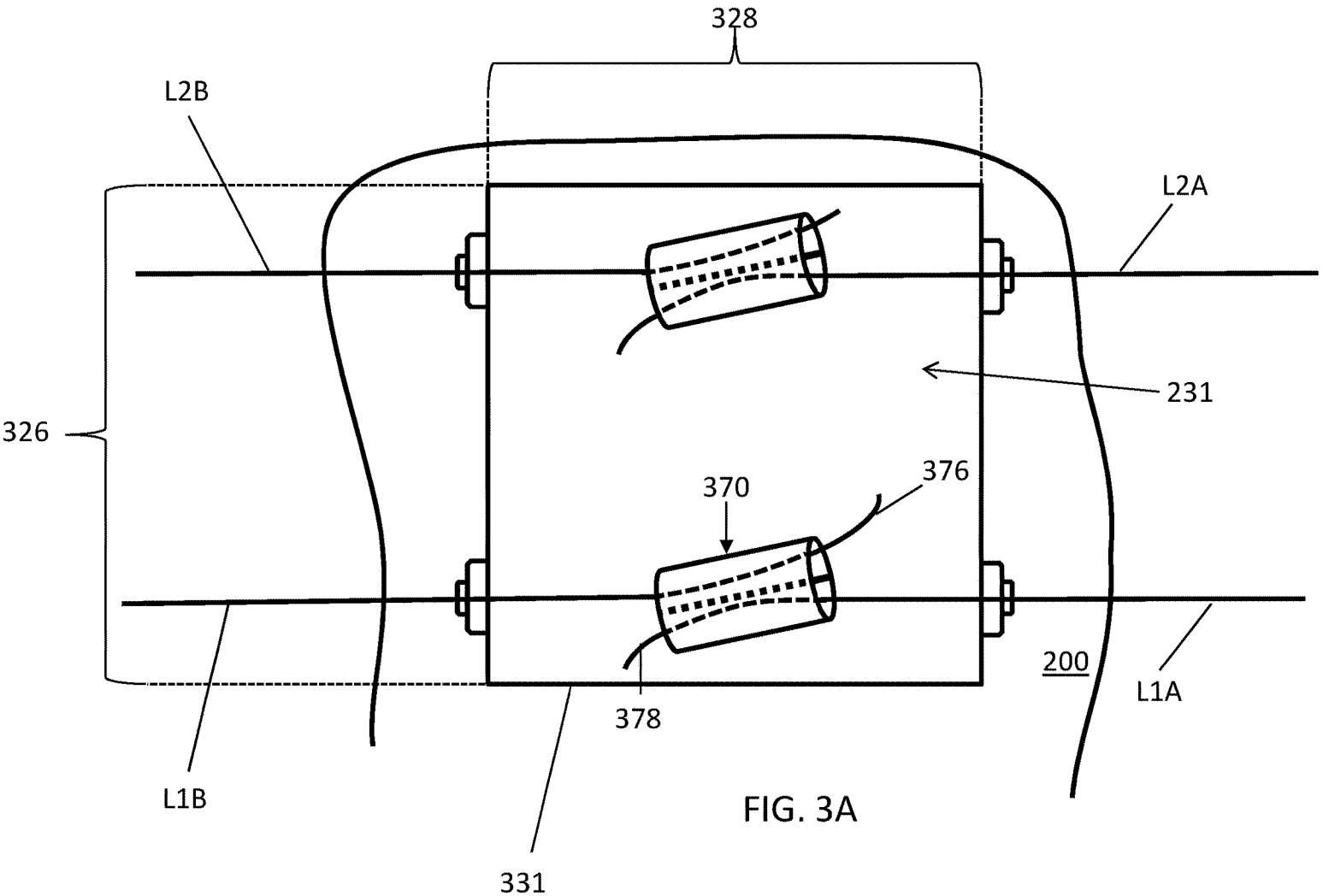
FIG. 3A illustrates a top plan view of a box-out area of the exemplary running track of FIG. 1 constructed in accordance with one or more of the disclosed embodiments.
Figure 3B:
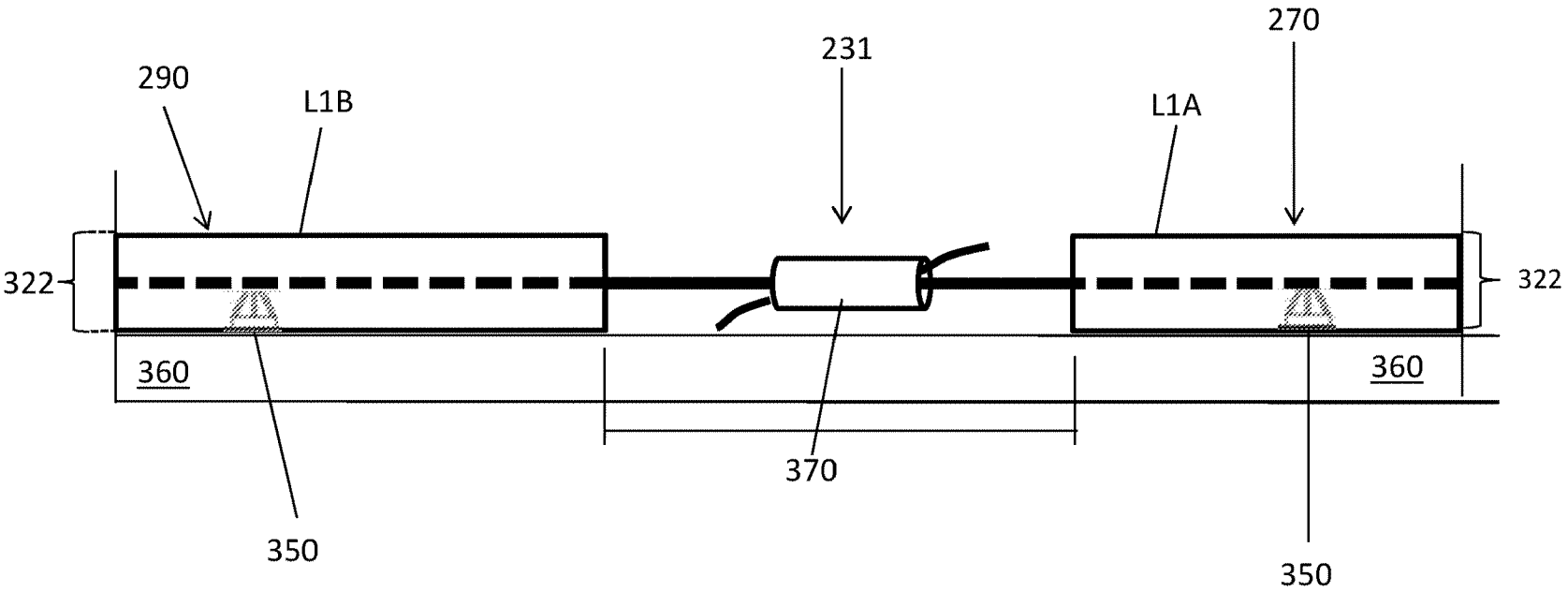
FIG. 3B illustrates a side elevation view of a box-out area of the exemplary running track of FIG. 1 constructed in accordance with one or more of the disclosed embodiments.

An exemplary configuration of a box-out in accordance with one or more of the exemplary embodiments is provided in FIGS. 3A-3B. FIG. 3A is a cut-away top-plan view of box-out 231 and the surrounding base 200. The other box-outs in sets 220, 230, 240 and 250 can have a similar configuration as box-out 231 described herein.

As shown in FIG. 3A, box-out 231 is defined by a form 331 used to provide a void within the base 200 during the initial pouring of the concrete of the base. Preferably, the box-outs have a size that is suitable for joining and tensioning the individual cable segments that begin or end in the box-out. In this exemplary implementation, the box-out has a length 328 and width 326 and is approximately 3 feet square and has a height that extends through the thickness of the base (e.g., 4.5 inches). The size and shape of a box-out can be a function of how many lengthwise cables run through the box-out, the spacing of the lengthwise cables, the requirements of the tensioning jacks and, as previously mentioned, variables related to the desired structural characteristics of the base in and around the box-outs.

In practice, the box out form 331 can be pre-made such that it is ready to drop into a respective location in the footprint of the base during the cable layout process and/or during concrete placement. The walls of the box-out forms can also include slots configured to allow the longitudinal cable segments to extend through the sides and into the interior area of the box-out.

As shown, one end of lengthwise cable segments L1A and L2A extend into the box out through one side of the form and cable segments L1B and L2B similarly extend into the box-out 231 through the opposing side of the form. In this exemplary configuration, the adjacent cable segments are spaced approximately 2 feet apart from one another. Although the exemplary box-out 231 is shown and described as having two lengthwise cables extending therethrough, in some implementations, a single box-out can accommodate one lengthwise cable or, in addition or alternatively, more than two lengthwise cables.

FIG. 3B is a cut-away side elevation view of box-out 231 and the surrounding base 200. FIG. 3B depicts a sub-base 360 on which the concrete base 200 is poured and the top surface 270 of the base. The sub-base can be comprised of, for example and without limitation, an existing asphalt or gravel base upon which the concrete base is formed and rests. Furthermore additional layers of material can be provided between the sub-base and base, such as a layer of plastic sheeting. Chairs 350 are also shown in FIG. 3B supporting the lengthwise cable segments L1A and L1B. As would be understood in the art, "chairs" are used to support post-tensioning cables at a given level prior to pouring the concrete base over that section of post-tensioning cables. Accordingly, the chairs ensure that the cables maintain at a certain level and allow the poured concrete base to form around the cables, thereby suspending the cables within the base at a prescribed depth or height. Although chairs are shown as supporting the lengthwise cables, as further described herein, chairs can similarly be used to support transverse cables or any other post-tensioning cables. For instance, chairs can be placed at the intersections of the lengthwise and transverse cables so as to support all of the post-tensioning cables on a generally even plane and allow the formation of the concrete base around the network of cables.

FIGS. 3A and 3B further illustrate the connection of two lengthwise cable segments end-to-end within the box-out in accordance with one or more of the disclosed embodiments. Various conventional coupling means can be used to fixedly connect lengthwise cables that are exposed within the box-outs in series (e.g., the distal end of cable L1A and the proximal end of cable L1B) to one another including but not limited to mechanical fasteners. Preferably, mechanical fasteners that allow the cable segments to be connected and then selectively tensioned within the box-outs are used. In the exemplary embodiment shown in FIGS. 3A and 3B, the free ends of the longitudinal cable segments (i.e., end 376 of lengthwise cable segments L1A and end 378 of lengthwise cable segment L2A) are passed through opposite ends of an adjustable coupling referred to as a "dog-bone" 370 and are mechanically engaged by the dog-bone to form a continuous cable structure. The dog-bone can also accommodate or include one or more locking mechanisms (e.g., a wedge, not shown) that allows each cable segment to be pulled through the dog-bone in a direction away from the opposite end of the cable (so as to selectively adjust the position of the dog-bone on the cable segment and the tension on the cable segment) and prevents the cable segment from relaxing or retracting back towards the opposite end of the cable segment.

As previously noted, certain portions of the base 200 have a consistent width defined by an inside edge 40 and outside edge 45 that extend in parallel. For example, FIG. 4A, shows the inside edge 40 and outside edge 45 of the base extending in parallel throughout the curved portion and linear length of quadrant A. Similarly, FIG. 4B, which depicts adjacent quadrant B of the base, further illustrates how the width of the base remains generally consistent as it extends from horizontal axis 62 to the apex of the turn at vertical axis 60. However, as previously noted, certain portions of the base can have an irregular width and footprint. For example, FIGS. 4C and 4D depict extension areas 35 and 30 provided in quadrants C and D, respectively.

Inclusion of extension areas or other irregularities in the footprint can require deviation from the otherwise uniform transverse orientation and spacing of the transverse cables to achieve proper width-wise compression of the base in the extension areas. For instance, FIG. 4C depicts extension are 35 located near the end of the turn, and also shows a number of transverse post-tensioning cables 420 (individually 421-441) extending through the base. As s shown, the cables 420 are oriented perpendicular to the linear outside edge 45 of the base 200 and extend across the width of the extension area and, in some locations, across the width of the curved portion of the base. In particular, transverse cables 421-424 are shown extending directly across the extension area to the opposing side of the extension area. Transverse cables 426-441 extend perpendicularly from the outside edge 45 to the inside edge 40 of the track. In addition, one or more of the transverse cables, (i.e., 426 and 427), are shown as overlapping with one or more other transverse cables within in the base (i.e., cables 451-453). FIG. 4D shows the opposing extension area 30 of the track 100 having a similar configuration.

In some implementations additional longitudinal oriented post-tensioning cables can be provided within the base. For instance, as shown in FIGS. 4C and 4D, base 200 includes one or more linear lengths of post-tensioning cables that extend longitudinally/lengthwise between the ends of extension areas 30 and 35. These additional longitudinal cables can be comprised of a single cable segment or multiple segments of cable that are connected in series to define a continuous cable. In particular, the portion of the running track shown in FIGS. 4C and 4D includes longitudinal cable segments CIA and C1B, C2A and C2B, C3A and C3B, C4A and C4B that, respectively, are joined end-to-end in box out 257 or 258. The longitudinal cables can be anchored at the ends of the extension areas 30 and 35 in the same manner as the transverse cables (e.g., using dead and/or live anchors). The cable segments can be joined end-to end in the box-outs in the same manner as the lengthwise cable segments.

As shown, these longitudinal cable segments C1A/B-C4A/B are provided within the base 200 next to the lengthwise cables (e.g., L1-L12), which run entirely around the oval portion of the base, and serve to widen the footprint of the base in this side area. Accordingly, linear longitudinal cable segments can be situated on the same general plane as the lengthwise cable loops. Moreover, preferably, the longitudinal cable segments are generally evenly spaced apart within the base. Accordingly, all of the cables extending through the side area (i.e., 15 shown in FIG. 1) of the running track, namely, the lengthwise cable segments forming the loops and the longitudinal cable segments, are generally evenly spaced across the width of the base and thereby exert compressive forces the lengthwise direction that are generally uniform across the entire width of the base.

FIG. 5D provides a close-up view of box-out set 250, and shows the ends of C1A/C1B and C2A/C2B joined at box-out 257 and C3A/C3B and C4A/C4B joined at box out set 257. As shown in FIG. 5D, box out set 250 includes box-outs 257 and 258 in addition to the six box-outs used to join lengthwise segments L1C/D-L12C/D. Preferably the box-outs that are used to join two longitudinal cable segments end to end are positioned within the footprint such that the segments have approximately equal length. For example, FIG. 5D shows box-outs 257 and 258 located near the horizontal axis 62. FIG. 5D also shows the box outs 257 and 258 situated toward the outside edge 45 of the base and spaced apart in the transverse direction. In addition, as shown, the box-outs 257 and 258 are also positioned in line (in the transverse direction) as box-out 253. Alternative configurations of the box-outs can be implemented without departing from the scope of the disclosed embodiments of the invention.

The foregoing exemplary embodiments of a post-tension running track will be further appreciated in view of the following description of an exemplary method for constructing a post-tension running track in accordance with one or more of the disclosed embodiments.

Figure 6:
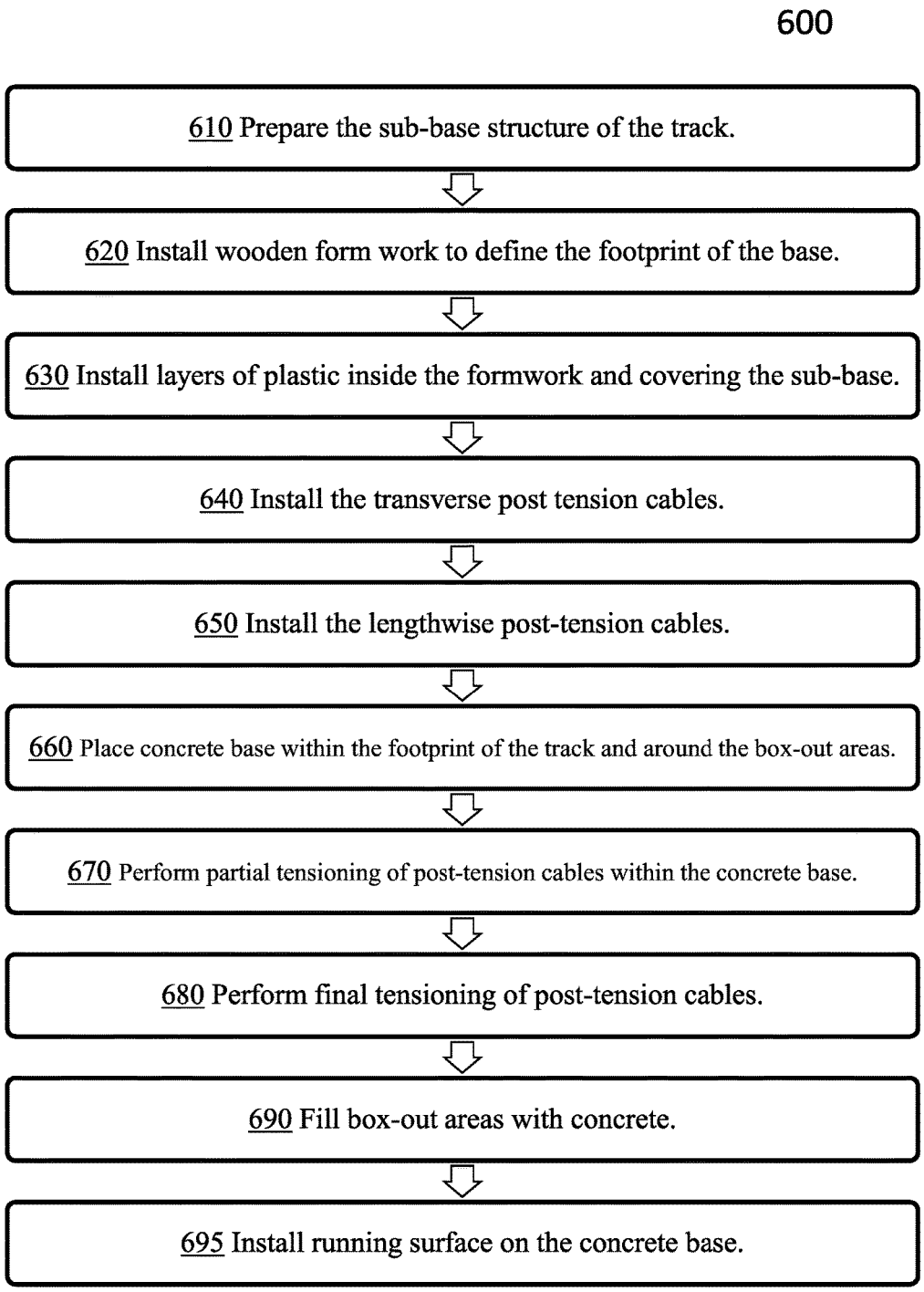
FIG. 6 is a flow diagram that illustrates a method of manufacturing a post-tension running track according to one or more of the exemplary embodiments of the present invention.

FIG. 6 is a flow diagram that illustrates a method of manufacturing a post-tension running track according to one or more of the exemplary embodiments of the present invention. Accordingly, the operations described herein are referred to variously as operations, steps, structural devices, or acts. It should be appreciated that more or fewer steps can be performed than shown in the figures and described herein. These steps can also be performed in a different order than those described herein.

The method of manufacture begins at step 610 where the sub-base structure of the track is prepared and a perimeter beam or haunch, as described previously, is dug out along the outside of the turns on the track. In some exemplary implementations, the perimeter haunch is two feet wide by one foot deep.

Then at step 620, form work is installed around the entire inside and outside perimeter of the running track. In some implementations, one or more sections of formwork can be left out in order to allow access for concrete trucks entering onto the track footprint during concrete placement.

Then at step 630, one or more layers of plastic are installed covering the sub-base (e.g., an existing asphalt base or gravel base) inside the formwork. For instance, two layers of six (6) mil poly plastic can be used and the joints of the poly plastic can be taped and sealed.

Then at step 640, the transverse post-tensioning cables are installed. For instance, the post-tensioning cables can be one-half inch (½") diameter, 7 strand un-bonded post-tensioning cables. As explained previously, the transverse post-tensioning cables extend across the width of the track at a respective location and are spaced apart from one another throughout the entire length of the track. Each transverse cable is fixedly attached at one end to a dead-end anchor, which is installed within the footprint near the inside edge of the track such that it will be embedded in concrete during concrete placement. In addition, the opposing free end of the transverse cables are passed through respective live-end anchors that are disposed at the outside edge of the footprint. After the transverse cables are installed, additional reinforcement can be installed along the entire perimeter of the inside and outside edge of the track, for instance, #4 rebar can be installed along the inside and outside perimeter of the track to act as back-up bars.

Then at step 650, the lengths of post-tension cables that extend lengthwise through the track are installed. In particular, the sets of lengthwise cable segments that eventually are connected to define continuous lengths of cables extending the length of the track are laid-out on top of the previously arranged transverse cables. As previously noted, the post-tensioning cables include an outer sheath that typically is a smooth polymer material. Accordingly, by laying out the lengthwise cables on top of the transverse cables, the longer and heavier lengthwise cables can be more easily moved into their respective positions within the footprint by sliding the lengthwise cables over the top of transverse cables. In some implementations, the post-tensioning cables can be one-half inch (½") diameter, 7 strand un-bonded post-tensioning cables. As previously noted, the spacing of the lengthwise cables will depend on overall length, width, and required compression in the slab. In addition, during installation of the lengthwise cables, intersecting lengthwise cables and transverse cables can be tied together, for instance, using rebar ties, so as to prevent the post-tensioning cables from moving independently during placement of concrete.

Each lengthwise cable can be installed in four separate segments. Each segment starts and ends in a box out area which will be isolated from the remainder of the concrete base using forms during concrete placement. As previously noted, in one or more of the exemplary embodiments, sets of box out areas/voids (where cable segments begin or end) are strategically located in the footprint in four different locations. In addition, the individual box-out areas in each set are set-apart from one another in both the lengthwise direction and in the transverse direction. These box out areas will eventually be used as the stressing locations of the lengthwise cable segments once the concrete slab is placed and ultimately filled with concrete to complete the base structure.

As previously noted, the individual box outs areas can be defined using box out forms that are pre made such that they are ready to be dropped into their respective places while pouring the concrete base.

Then at step 660, the main concrete structure forming the base is placed/poured within the footprint of the track. For instance, placement of concrete can begin at a starting location within the footprint and can proceed progressively around the length of the track until finishing back at the starting location. In the exemplary process further described herein, the placement of concrete throughout the entire footprint of the base, with the exception of the box-out areas that are voids left unfilled with concrete during the initial formation of the concrete base, occurs in a single pouring stage. However, alternatively the main concrete placement process can occur in multiple stages, for example, in two stages over the course of two days.

In one exemplary implementation, concrete placement can include driving the concrete trucks through the footprint of the track on top of the post-tensioning cables while pouring the concrete out of the shoots of the trucks within the footprint of the base. Because the concrete trucks drive on top of the post-tensioning cables within the footprint of the track, installation of chairs supporting the post-tensioning cables and any box-out forms and/or keyways that are designed to be located in a particular portion of the track is preferably performed after the concrete truck drives over that particular portion of the track and before the concrete is poured out of the chute onto that particular portion of the track. In other words, as the concrete truck(s) progressively move backwards around the track dispensing concrete from a chute extending beyond the front end of the truck, workcrews can systematically install chairs and any box-out forms and keyways, as necessary, in the area between the front of the truck and the end of the concrete chute.

In addition, during the progressive placement of the concrete, the poured concrete can be screeded evenly within the footprint the track across the entire width to achieve a desired flatness and tolerance, for instance, flatness within a ⅛" in 10 foot tolerance.

The exemplary design of the running track and methods of construction, which enables placement of the concrete by driving the trucks within the footprint of the track, provides a number of practical benefits. In particular, it avoids requiring concrete pumping units to be used to pump concrete from the trucks from outside of the footprint into the footprint. It also avoids having to drive or move concrete trucks and other such concrete pouring machinery in the area surrounding the outside edge of the track or the interior area, where space might be limited, say, due to existing structures outside the footprint (e.g., bleachers) or fields within the interior area. Moreover, in accordance with the exemplary method, concrete placement can occur in one continuous stage.

Then at step 670, after the main portion of the concrete base is placed and is allowed to cure a prescribed amount (e.g., for a prescribed period of time or degree), the forms defining the footprint of the base and the box-out areas can be removed and a partial tensioning of the post-tensioning cables can be performed. More specifically, for the transverse cables, wedges can be placed in the live-end anchors and tensioning/stressing equipment can be used to tension the cables. In some implementations, the initial stressing can include tensioning the cables to about one half of the designed pressure for the base. In addition, the sets of lengthwise cable segments extending lengthwise through the base of the track can be connected to end-to-end within respective box-outs using a "dog bone" thereby resulting in the formation of continuous lengthwise cable structures within the base that extend completely and continuously about the track. Each continuous lengthwise cable structure is also tensioned by tensioning the constituent lengthwise cable segments from each ends thereof. In particular, a first lengthwise cable segment can be tensioned within a first box-out by placing a wedge within the dog bone connecting an end of the first lengthwise cable segment to the end of a second lengthwise cable segment. The first lengthwise cable segment can then be tensioned or pulled from its free end through the dog bone using tensioning equipment until the cable is tensioned a prescribed amount. For instance, the cable segments can be initially tensioned such that they place about half the designed pressure on the base. This process can then be repeated on the end of the other lengthwise cable segment that is also coupled to the dog bone. The process can then be repeated at each of the remaining box-outs until each lengthwise cable segment has a prescribed tension and, thus, the corresponding continuous lengthwise cable structures have a prescribed tension.

Then at step 680, once the concrete reaches a prescribed pressure, the tensioning of the lengthwise and transverse cables can be repeated to achieve the final designed pressure for the base. For example and without limitation, the prescribed pressure within the base that can be required before final tensioning can be 2500 psi. The prescribed pressure can vary depending on the particular requirements of the track. Similarly, the tensioning can occur in one or more stages depending on the implementation and requirements. Accordingly, alternative pressure requirements and more or fewer tensioning steps can be implemented without departing from the scope of the exemplary embodiments of the invention.

Then at step 690, the box outs areas are filled with concrete and surrounds any joined lengthwise cable segments previously exposed therein. The concrete can also be leveled, thereby complete the construction of the concrete base structure. Accordingly, a concrete base structure having a top-surface layer of concrete extends throughout the footprint length of the base.

In addition, at step 695, a running surface of the track can be installed on the top-surface of the base. Various running surfaces can be used to provide a top-surface for the track. However, an exemplary configuration of a running track surface is further described herein. The running track surface can be a composite structure that includes a plurality of material layers that are each comprised of one or more materials. Preferably, the main structure of the running track surface is an elastic polymer base mat that is prefabricated and provided in one or more elongate sections and installed on the top surface of the base of the track. In some implementations, the polymer base mat can be a styrene-butadiene rubber (SBR) mat. More specifically, the mat can be a thermal and pressure cured, post-consumer recycled SBR substrate that is provided in roll form and is laid out over the top-surface of the base and laminated to the surface, as further described herein.

In addition, the base mat can be adhered to the concrete base using an adhesive. In some implementations, the adhesive is a one part moisture curing polyurethane adhesive. The adhesive is applied to the top surface of the concrete base during installation of the rubber base mat. Preferably, the adhesive is applied throughout the interface between the top-surface of the concrete base and the underside of the SBR rubber base mat. Accordingly, the base mat can be effectively laminated to the top surface of the base throughout substantially the entire interface between the underside of the base mat and the top surface of the base.

In one or more exemplary implementations, the prefabricated SBR base mat is then be coated with a polyurethane wearing course that is applied in liquid or viscous form in one or more stages and allowed to dry. Preferably, coating of the base mat with the polyurethane wearing course can occur in two application stages. The first application can be considered a pore sealing stage, in which a two part urethane is applied to the top surface of the base mat with a metal scraper. The purpose of the pour sealing stage is to fill and seal voids in the top of the base mat. Accordingly, a second coat (referred to as the "flow coat") can be precisely applied to a prescribed amount (e.g., a certain weight of material per square yard) and remains on the top of the surface of the base mat. In some implementations, the flow coat can be comprised of a two part urethane and, for example and without limitation, can be applied with a ⅜" notched squeegee. During the application of the flow-coat, additional materials can be also applied to the wet surface. For instance, a polymer material such as EPDM having a suitable size (e.g., EPDM pellets that are sized between 1-3 mm each) can be broadcast in excess over the flow coat to provide texture to the top layer of the running track surface. The amount of EPDM that is broadcast over the flow coat can depend on the desired texture of the running track. After the flow coat is dry, the excess EPDM that did not stick to the flow-coat can be picked up.

The exemplary surface of the running track that utilizes a prefabricated base mat provides improvements over existing composite running track surfaces that are provided on top of a concrete/asphalt structural base. Many existing track surface systems are constructed using a base substrate layer that is poured in liquid form in place over the concrete base of the track. For instance, an SBR rubber and a binder (glue) are mixed on site and installed with a small size paving box over the surface of the structural base to provide the base-layer of the running surface. This process, however, fails to achieve as high a compression and/or density of material within the base layer that can be achieved when utilizing a prefabricated base mat described above. Accordingly, such poured base layers are less durable over time than using prefabricated base mat for the base layer of the running surface. Another salient difference is the improved adhering strength provided by using a moisture curing polyurethane to adhere the base mat to the concrete base. For instance, the moisture curing polyurethane adhesive can achieve adhesion of four thousand psi holding the base mat to the top surface of the concrete base. The pour-in-place base mat configurations have significantly less adhesion and have been measured to have adhesion that is half or less than the adhesion provided when using the moisture curing polyurethane adhesive in accordance with the disclosed embodiments. Moreover, breathing of the structural base (e.g., concrete, asphault or other such base structure), can cause moisture to accumulate under pour-in-place running surface base substrates and, thus, causes loosening of the running surface base layer and the wearing layers (i.e., the top layers) of the running track surface.

Other existing track surface systems include pre-made track surfaces that are entirely pre-made and then stabilized to the concrete base of the track to complete installation. However, such systems can have durability issues because they lack a top-coating that is applied in the field during installation and that seals the entire running track surface from the top. By comparison, the exemplary embodiment of the running track surface, which includes a top surface layer that is applied in liquid or viscous form over the entire base mat provides a sealing layer extending over the entire composite running-track surface and the edges of the running track surface.

Further benefits of the exemplary running track surface comprising a pre-fabricated SBR base mat that is coated with the viscous polyurethane and EPDM wearing course is that the wearing course can be repaired or reapplied after years of use with relatively low cost and effort. In particular, the top-most wearing courses can be removed from the SBR base mat (e.g., using a surface grinder) and without removal of the base mat. The wearing course can then be re-applied as described above.

Thus, while there have been shown, described, and pointed out fundamental novel features of the invention as applied to several embodiments, it will be understood that various omissions, substitutions, and changes in the form and details of the devices illustrated, and in their operation, may be made by those skilled in the art without departing from the spirit and scope of the invention. Substitutions of elements from one described embodiment to another are also fully intended and contemplated. It is also to be understood that the drawings are not necessarily drawn to scale, but that they are merely conceptual in nature. The invention is defined solely with regard to the claims appended hereto, and equivalents of the recitations therein.

What is claimed:

1. A method of constructing a post-tensioned running track, the method comprising:

forming a footprint of a base, wherein the footprint of the base has an inner edge, an outer edge and a width there-between and extends continuously around an interior area;

arranging a plurality of transverse post-tensioning cables within the footprint, wherein the transverse cables extend in a transverse direction across the width at respective locations;

arranging multiple sets of lengthwise post-tensioning cable segments within the footprint, wherein each set comprises a plurality of lengthwise cable segments arranged in series and extending in a lengthwise direction such that each set of lengthwise cable segments extends about the footprint at a respective position between the inner edge and the outer edge;

defining sets of box-out areas within the footprint using box-out forms, wherein the sets of box-out areas are spaced apart in the lengthwise direction, and wherein each set of box-out areas includes a plurality of individual box out areas that are spaced apart in the transverse direction, and wherein the lengthwise cable segments begin and end in respective box-out areas;

placing concrete throughout the footprint to form a concrete base structure, wherein the concrete base structure is formed around sides of the box-out forms thereby leaving any ends of lengthwise cable segments exposed within respective box-out areas defined by respective box out forms;

for each set of lengthwise cable segments, joining the lengthwise cable segments in series in respective box-out areas thereby defining a respective lengthwise cable structure that extends continuously about an entire circumferential length of the base;

performing a partial tensioning of the transverse and lengthwise cable segments; and performing a final tensioning of the transverse and lengthwise cable segments; and filling the box-out areas with concrete thereby surrounding respective joined lengthwise cable segments disposed within the box-out areas with concrete so as to provide a concrete base structure having a top-surface layer of concrete that extends throughout the footprint of the track, and wherein compression on the concrete base structure in the lengthwise direction is continuous and uninterrupted about the entire circumferential length of the base.

2. The method of claim 1, wherein the step of placing the concrete throughout the footprint comprises:

progressively pouring concrete within the footprint starting at a start location and progressing along the length of the footprint in the lengthwise direction; and wherein any box-out areas within a respective portion of the footprint are separated from the surrounding areas within the footprint using box-out forms prior to pouring concrete within the respective portion of the footprint.

3. The method of claim 2, further comprising:

tying the lengthwise cable segments to one or more of the transverse cables at one or more intersections thereof; and supporting any lengthwise cable segments and any transverse cable segments within the respective portion of the footprint at a given height prior to pouring concrete within the respective portion of the footprint, thereby suspending any lengthwise cable segments and any transverse cables within the respective portion of the footprint at the given height within the poured concrete base.

4. The method of claim 3, further comprising:

placing keyways within the footprint, wherein the keyways are spaced apart in the lengthwise direction, and wherein the keyways are configured to extend through the footprint in the transverse direction at respective locations and arranged such that a top surface layer of the concrete base extends over a top of the keyways after concrete placement.

5. The method of claim 2, further comprising:

driving concrete trucks throughout the footprint on top of the post-tensioning cables arranged therein and pouring the concrete from the trucks starting at the start location and progressing in the lengthwise direction through the footprint so as to progressively define the concrete base structure and ending the concrete placement at the starting location.

6. The method of claim 1, wherein the step of forming a footprint of a base further comprises:

defining one or more haunches within the footprint to be filled with concrete during concrete placement, wherein the one or more haunches are portions of the concrete base that extend deeper into a sub-base layer, and wherein the haunches extend along the outside edge of the poured concrete base at a respective curved end section of the base.

7. The method of claim 1, wherein the partial tensioning of the lengthwise cable segments comprises:

tensioning each lengthwise cable segment to a prescribed degree at both a first and second end thereof within respective box-out areas; and wherein the partial tensioning of the lengthwise cable segments is performed after the concrete base structure has cured a prescribed amount.

8. The method of claim 7, wherein the final tensioning of the lengthwise cable segments is performed after one or more of: a prescribed curing period and a prescribed compression is achieved within the concrete base structure.

9. The method of claim 1, wherein opposing free ends of lengthwise cable segments arranged in series are mechanically coupled within a respective box-out area using a dog-bone coupling device that is configured to allow for the selective tensioning of the lengthwise cable segments coupled thereto.

10. The method of claim 1, wherein the continuous lengthwise cable structures are spaced apart in the transverse direction.

11. A post-tensioned running track comprising:

a concrete base extending circumferentially around an interior area, wherein the concrete base includes an inner edge and an outer edge and a width there-between;

a plurality of transverse post-tensioning cables provided within the concrete base and extending in a transverse direction across the width of the concrete base at respective locations;

multiple sets of box-out areas provided in the concrete base, wherein the sets of box-out areas are spaced apart from one another along the length of the concrete base, and wherein each set of box-out areas includes:

a plurality of individual box outs areas that are spaced apart in the transverse direction such that a portion of the concrete base extends in the lengthwise direction between at least two of the box-out areas in the set; and multiple sets of lengthwise cable segments suspended within the concrete base, wherein each set of lengthwise cable segments comprises:

a plurality of lengthwise cable segments arranged in series and extending in a lengthwise direction such that each set of lengthwise cable segments extends about the footprint at a respective position between the inner edge and the outer edge, and wherein the series of lengthwise cable segments in each set are joined end to end in respective box-out areas thereby defining respective lengthwise cable structures that extend continuously about an entire circumferential length of the concrete base in the lengthwise direction.

12. The post-tensioned running track of claim 11, wherein each set of joined lengthwise cable segments are under tension so as to provide a respective lengthwise cable structure that is continuously under tension along its entire circumferential length and thereby provides a reinforced concrete base structure under compression in the lengthwise direction, wherein the compression in the concrete base is continuous and uninterrupted along the entire circumferential length of respective lengthwise cable structures.

13. The post-tensioned running track of claim 11, wherein each box-out area is a section of the concrete base that surrounds respective joined lengthwise cable segments disposed therein.

14. The post-tensioned running track of claim 11, wherein at least four sets of box-out areas are provided in the concrete base and are arranged in series, and wherein successive sets of box-out areas have a generally even spacing there-between.

15. The post-tensioned running track of claim 11, wherein each box-out area in a set are spaced apart from any adjacent box-out areas in the set.

16. The post-tensioned running track of claim 11, further comprising:

keyway structures disposed within the concrete base, wherein the keyways extend through the concrete base in the transverse direction at respective locations and are configured to allow one or more lengthwise cable segments to extend through the keyways uninterrupted, and wherein the keyways are disposed within the concrete base such that a top surface layer of the concrete base extends over a top of the keyways.

17. The post-tensioned running track of claim 11, wherein the concrete base comprises:

a first concrete base structure extending between successive box-out sets and in between the spaced-apart box-out areas in each set of box out areas, wherein the first concrete base structure has at least a top layer of concrete that extends continuously in the lengthwise direction about the circumferential length of the concrete base; and wherein each of the box-out areas is a separately poured section of concrete that surrounds respective joined lengthwise cable segments disposed therein, and that is surrounded on all sides by the first concrete base structure.

18. The post-tensioned running track of claim 11, wherein the concrete base is defined by two opposing, generally semi-circular end areas, and two opposing generally rectangular side areas connecting the end areas so as to define a generally oval-shaped base.

19. The post-tensioned running track of claim 11, wherein the transverse cables extend from the inside edge of the concrete base towards a corresponding location on the opposing outer edge of the concrete base, and wherein the plurality of transverse cables are spaced apart from one another throughout the circumferential length of the concrete base.

20. The post-tensioned running track of claim 11, further comprising:

a composite running track surface disposed on top of a top surface of the concrete base, wherein the composite running track surface comprises:

a base-mat layer comprised of a plurality of prefabricated rubber base mat sections, wherein the sections of the base-mat layer are adhered to the top surface of the concrete base using a moisture curing polyurethane adhesive, and one or more polyurethane wearing courses that are applied over the base mat in liquid form and allowed to cure.

21. A method of constructing a post-tensioned running track, the method comprising:

arranging, within a predefined footprint of a base, multiple sets of lengthwise post-tensioning cable segments, wherein each set comprises a plurality of lengthwise cable segments arranged in series and extending in a lengthwise direction such that each set of lengthwise cable segments extends about the footprint at a respective position between an inner edge and an outer edge of the base;

forming a concrete base structure, wherein the concrete base structure is formed around the sets of lengthwise cable segments such that free opposing ends of successive cable segments of each set are disposed within a discrete respective void formed in the concrete base structure;

the respective voids being formed within the concrete base structure such that they are spaced apart from any adjacent respective voids in the transverse direction;

for each set of lengthwise cable segments, joining the lengthwise cable segments in series in respective voids thereby defining a respective lengthwise cable structure that extends continuously about an entire circumferential length of the base;

performing a partial tensioning of the lengthwise cable segments; and performing a final tensioning of the lengthwise cable segments; and filling the voids with concrete thereby surrounding respective joined lengthwise cable segments disposed therein with concrete.

* * * * *